US011974610B2

(12) United States Patent
Liu

(10) Patent No.: US 11,974,610 B2
(45) **Date of Patent: *May 7, 2024**

(54) ELECTRONIC SMOKE APPARATUS

(71) Applicant: Altria Client Services LLC, Richmond, VA (US)

(72) Inventor: Loi Ying Liu, Hong Kong (CN)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 1239 days.

This patent is subject to a terminal disclaimer.

(21) Appl. No.: 16/560,495

(22) Filed: Sep. 4, 2019

(65) Prior Publication Data

US 2019/0387804 A1 Dec. 26, 2019

Related U.S. Application Data

(63) Continuation of application No. 14/793,453, filed on Jul. 7, 2015, now Pat. No. 10,420,374, which is a (Continued)

(30) Foreign Application Priority Data

Sep. 18, 2009 (CN) ..... 200920179316.6

(51) Int. Cl.
*A24F 40/51* (2020.01)
*A24F 40/10* (2020.01)

(52) U.S. Cl.
CPC ..... *A24F 40/51* (2020.01); *A24F 40/10* (2020.01)

(58) Field of Classification Search
CPC ..... A24F 47/008; A24F 47/002; G01L 9/0072
See application file for complete search history.

(56) References Cited

U.S. PATENT DOCUMENTS 2,200,863 A 5/1940 Hugo
2,907,320 A 10/1959 De Weese
(Continued)

FOREIGN PATENT DOCUMENTS

AU 2008351672 9/2009
CA A-2169765 2/1995
(Continued)

OTHER PUBLICATIONS

Wei, Ze-Wen et al., "A Novel 2-D Capacitive Silicon Flow Sensor", IEEE Sensors 2007 conference, 2007.
(Continued)

*Primary Examiner* — Gary F Paumen
(74) *Attorney, Agent, or Firm* — Harness, Dickey & Pierce, P.L.C.

(57) ABSTRACT

An electronic smoke comprises a puff detection sub-assembly module. The puff detection sub-assembly comprises a first conductive surface, a second conductive surface and an insulated ring spacer separating the first and the second conductive surfaces at an effective separation distance. The first conductive surface, the second conductive surface and the insulated ring spacer are housed inside a metallic can. The first conductive surface is electrically connected to the metal can by a first conductive ring which is disposed between the first conductive surface and a ceiling portion of the metal can. The second conductive surface is electrically connected to an output terminal through a second conductive ring, the second conductive ring elevating the puff detection sub-assembly above a floor portion of the metal can and urging the first conductive ring against a ceiling portion of the metal can.

30 Claims, 15 Drawing Sheets

Figure 1:
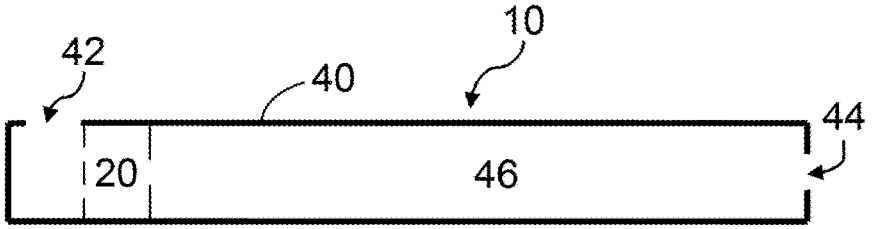

Related U.S. Application Data continuation-in-part of application No. 13/131,705, filed as application No. PCT/IB2010/052949 on Jun. 29, 2010, now Pat. No. 9,072,321.

(56) References Cited

U.S. PATENT DOCUMENTS

| | | | |
|---|---|---|---|
| 3,389,601 | A | 6/1968 | Semplak |
| 3,534,728 | A | 10/1970 | Barrows |
| 3,814,998 | A | 6/1974 | Thoma et al. |
| 3,946,726 | A | 3/1976 | Pikul |
| 3,965,746 | A | 6/1976 | Rabek |
| 4,141,252 | A | 2/1979 | Lodge |
| 4,206,644 | A | 6/1980 | Platt |
| 4,484,479 | A | 11/1984 | Eckhardt |
| 4,488,439 | A | 12/1984 | Gast et al. |
| 4,490,773 | A | 12/1984 | Moffatt |
| 4,599,907 | A | 7/1986 | Kraus et al. |
| 4,876,892 | A | 10/1989 | Arabia et al. |
| 4,922,901 | A | 5/1990 | Brooks et al. |
| 4,945,929 | A | 8/1990 | Egilmex |
| 5,052,400 | A | 10/1991 | Dietz |
| 5,107,860 | A | 4/1992 | Malouvier et al. |
| 5,134,886 | A | 8/1992 | Ball |
| 5,146,435 | A | 9/1992 | Bernstein |
| 5,388,594 | A | 2/1995 | Counts et al. |
| 5,641,911 | A | 6/1997 | Ryhanen |
| 5,665,262 | A | 9/1997 | Hajaligol et al. |
| 5,666,977 | A | 9/1997 | Higgins et al. |
| 5,692,525 | A | 12/1997 | Counts et al. |
| 5,692,526 | A | 12/1997 | Adams et al. |
| 5,902,501 | A | 5/1999 | Nunnally et al. |
| 5,934,289 | A | 8/1999 | Watkins et al. |
| 5,959,219 | A | 9/1999 | Saunders |
| 5,988,176 | A | 11/1999 | Baggett, Jr. et al. |
| 6,040,560 | A | 3/2000 | Fleischhauer et al. |
| 6,220,244 | B1 | 4/2001 | McLaughlin |
| 6,615,840 | B1 | 9/2003 | Fournier et al. |
| 6,803,545 | B2 | 10/2004 | Blake et al. |
| 6,803,550 | B2 | 10/2004 | Sharpe et al. |
| 6,810,883 | B2 | 11/2004 | Felter et al. |
| 7,171,012 | B2 | 1/2007 | Izuchi et al. |
| 7,353,711 | B2 | 4/2008 | O'Dowd et al. |
| 7,726,320 | B2 | 6/2010 | Robinson et al. |
| 7,832,410 | B2 | 11/2010 | Hon |
| 7,845,359 | B2 | 12/2010 | Montaser |
| 8,079,371 | B2 | 12/2011 | Robinson et al. |
| 8,091,558 | B2 | 1/2012 | Martzel |
| 8,127,772 | B2 | 3/2012 | Montaser |
| 8,156,944 | B2 | 4/2012 | Han |
| 8,205,622 | B2 | 6/2012 | Pan |
| 8,314,591 | B2 | 11/2012 | Terry et al. |
| 8,365,742 | B2 | 2/2013 | Hon |
| 8,375,957 | B2 | 2/2013 | Hon |
| 8,393,331 | B2 | 3/2013 | Hon |
| 8,490,628 | B2 | 7/2013 | Hon |
| 8,511,318 | B2 | 8/2013 | Hon |
| 8,550,068 | B2 | 10/2013 | Terry et al. |
| 8,661,910 | B2 | 3/2014 | Mclaughlin et al. |
| 8,689,805 | B2 | 4/2014 | Hon |
| 8,746,240 | B2 | 6/2014 | Terry et al. |
| 8,863,752 | B2 | 10/2014 | Hon |
| 8,863,753 | B2 | 10/2014 | Li et al. |
| 8,893,726 | B2 | 11/2014 | Hon |
| 8,897,628 | B2 | 11/2014 | Conley et al. |
| 8,899,238 | B2 | 12/2014 | Robinson et al. |
| 8,899,239 | B2 | 12/2014 | Hon |
| 8,910,641 | B2 | 12/2014 | Hon |
| 9,072,321 | B2 * | 7/2015 | Liu ..... G01P 13/0026 |
| 9,259,035 | B2 | 2/2016 | Terry et al. |
| 9,320,300 | B2 | 4/2016 | Hon |
| 9,326,548 | B2 | 5/2016 | Hon |
| 9,326,549 | B2 | 5/2016 | Hon |
| 9,326,550 | B2 | 5/2016 | Hon |
| 9,326,551 | B2 | 5/2016 | Hon |
| 9,339,062 | B2 | 5/2016 | Hon |
| 9,364,027 | B2 | 6/2016 | Hon |
| 9,370,205 | B2 | 6/2016 | Hon |
| 9,439,455 | B2 | 9/2016 | Alarcon et al. |
| 9,456,632 | B2 | 10/2016 | Hon |
| 9,497,996 | B2 | 11/2016 | Liu |
| 9,714,878 | B2 | 7/2017 | Powers et al. |
| 9,814,267 | B2 | 11/2017 | Liu |
| 9,968,132 | B2 | 5/2018 | Hon |
| 10,420,374 | B2 * | 9/2019 | Liu ..... A24F 40/51 |
| 2002/0005207 | A1 | 1/2002 | Wrenn et al. |
| 2002/0123669 | A1 | 9/2002 | Wickstrom |
| 2004/0129280 | A1 | 7/2004 | Woodson et al. |
| 2004/0187589 | A1 | 9/2004 | Ferran et al. |
| 2004/0200488 | A1 | 10/2004 | Felter et al. |
| 2005/0016550 | A1 | 1/2005 | Katase |
| 2005/0081639 | A1 | 4/2005 | Gourlay |
| 2005/0172976 | A1 | 8/2005 | Newman et al. |
| 2005/0229710 | A1 | 10/2005 | O'Dowd et al. |
| 2006/0196518 | A1 | 9/2006 | Hon |
| 2007/0006889 | A1 | 1/2007 | Kobal et al. |
| 2007/0102013 | A1 | 5/2007 | Adams et al. |
| 2008/0173303 | A1 | 7/2008 | McLaughlin et al. |
| 2009/0095311 | A1 | 4/2009 | Han |
| 2010/0200008 | A1 | 8/2010 | Taieb |
| 2010/0242974 | A1 | 9/2010 | Pan |
| 2011/0011396 | A1 | 1/2011 | Fang |
| 2011/0075863 | A1 | 3/2011 | Rosen et al. |
| 2011/0155151 | A1 | 6/2011 | Newman et al. |
| 2011/0226236 | A1 | 9/2011 | Buchberger |
| 2011/0277780 | A1 | 11/2011 | Terry et al. |
| 2011/0304282 | A1 | 12/2011 | Li et al. |
| 2012/0090630 | A1 | 4/2012 | Hon |
| 2012/0118301 | A1 | 5/2012 | Montaser |
| 2012/0234315 | A1 | 9/2012 | Li et al. |
| 2012/0273589 | A1 | 11/2012 | Hon |
| 2013/0139833 | A1 | 6/2013 | Hon |
| 2013/0263869 | A1 | 10/2013 | Zhu |
| 2014/0150810 | A1 | 6/2014 | Hon |
| 2014/0246020 | A1 | 9/2014 | Minskoff et al. |
| 2014/0299137 | A1 | 10/2014 | Kieckbusch et al. |
| 2015/0020825 | A1 | 1/2015 | Galloway et al. |
| 2015/0020831 | A1 | 1/2015 | Weigensberg et al. |
| 2015/0020833 | A1 | 1/2015 | Conley et al. |
| 2015/0040930 | A1 | 2/2015 | Robinson et al. |
| 2015/0047656 | A1 | 2/2015 | Robinson et al. |
| 2015/0053214 | A1 | 2/2015 | Alarcon et al. |
| 2015/0053217 | A1 | 2/2015 | Steingraber et al. |
| 2015/0059779 | A1 | 3/2015 | Alarcon et al. |
| 2015/0128974 | A1 | 5/2015 | Hon |
| 2015/0150306 | A1 | 6/2015 | Chen |
| 2015/0272224 | A1 | 10/2015 | Hon |
| 2015/0366267 | A1 | 12/2015 | Liu |
| 2016/0021930 | A1 | 1/2016 | Minskoff et al. |
| 2016/0073691 | A1 | 3/2016 | Liu |
| 2016/0213067 | A1 | 7/2016 | Hon |
| 2016/0213068 | A1 | 7/2016 | Hon |
| 2016/0255878 | A1 | 9/2016 | Huang et al. |
| 2016/0270448 | A1 | 9/2016 | Hon |
| 2016/0270449 | A1 | 9/2016 | Hon |
| 2016/0270450 | A1 | 9/2016 | Hon |
| 2016/0270451 | A1 | 9/2016 | Hon |
| 2016/0286865 | A1 | 10/2016 | King et al. |

FOREIGN PATENT DOCUMENTS

| | | |
|---|---|---|
| CN | 1040914 | 4/1990 |
| CN | 1530041 | 9/2004 |
| CN | 2643681 | 9/2004 |
| CN | 1541577 A | 11/2004 |
| CN | 1575673 A | 2/2005 |
| CN | 2719043 Y | 8/2005 |
| CN | 1717186 | 1/2006 |
| CN | 1741684 | 3/2006 |
| CN | 1791790 | 6/2006 |
| CN | 1284493 | 11/2006 |
| CN | 201051862 Y | 4/2008 |
| CN | 201054788 | 4/2008 |
| CN | 201054789 | 4/2008 |
| CN | 201054977 Y | 5/2008 |

(56) References Cited

FOREIGN PATENT DOCUMENTS

| | | | |
|---|---|---|---|
| CN | 101228969 | A | 7/2008 |
| CN | 101366554 | A | 2/2009 |
| CN | 201199922 | | 3/2009 |
| CN | 201238610 | Y | 5/2009 |
| CN | 101518361 | | 9/2009 |
| CN | 101518361 | A | 9/2009 |
| CN | 101524187 | A | 9/2009 |
| CN | 101606758 | A | 12/2009 |
| CN | 201482667 | U | 5/2010 |
| CN | 201490998 | | 5/2010 |
| CN | 201514238 | | 6/2010 |
| CN | 102227175 | A | 10/2011 |
| CN | 1864054 | | 8/2012 |
| CN | 103251133 | A | 8/2013 |
| CN | 103251133 | A | 8/2013 |
| CN | 203314104 | | 12/2013 |
| CN | 203913376 | | 11/2014 |
| CN | 203952419 | | 11/2014 |
| CN | 204070537 | | 1/2015 |
| CN | 204232300 | | 4/2015 |
| CN | 105476069 | A | 4/2016 |
| CN | 105876869 | A | 8/2016 |
| DE | 2802830 | A1 | 7/1979 |
| EP | 91522 | A2 | 10/1983 |
| EP | 0358114 | A2 | 3/1990 |
| EP | 0488488 | A1 | 6/1992 |
| EP | 0592173 | | 4/1994 |
| GB | 1252433 | | 11/1971 |
| GB | 1353197 | A | 5/1974 |
| JP | 63271121 | | 11/1988 |
| JP | H0348166 | | 3/1991 |
| JP | H6-117890 | | 4/1994 |
| JP | H7-506008 | A | 7/1995 |
| JP | 09005191 | | 1/1997 |
| JP | H09113326 | | 5/1997 |
| JP | 11351921 | | 12/1999 |
| JP | 2004163221 | | 6/2004 |
| JP | 2005-034021 | | 2/2005 |
| JP | 2005-265432 | | 9/2005 |
| JP | 2007-010484 | | 1/2007 |
| JP | 2009-066142 | | 4/2009 |
| JP | 2013-526834 | | 6/2013 |
| JP | 2014-521961 | | 8/2014 |
| KR | 1020050107739 | | 11/2005 |
| WO | WO-1992007599 | | 5/1992 |
| WO | WO-94/18860 | A1 | 9/1994 |
| WO | WO-03012565 | | 2/2003 |
| WO | WO-2004/043175 | A1 | 5/2004 |
| WO | WO-2004/080216 | A1 | 9/2004 |
| WO | WO-2004/086457 | | 10/2004 |
| WO | WO-2005/019785 | | 3/2005 |
| WO | WO-2007/131449 | A1 | 11/2007 |
| WO | WO-2008108889 | | 9/2008 |
| WO | WO-2009005211 | | 1/2009 |
| WO | WO-2010045671 | | 4/2010 |
| WO | WO-2011/033396 | A2 | 3/2011 |
| WO | WO-2015089711 | | 6/2015 |

OTHER PUBLICATIONS

Wolfgang Demtroder, "Experimentalphysik1 Mechanik und Warme", Springer-Verlag Berlin Heidelberg, 3rd edition, 2003.

Jin Hai Xu, "Capacitive Pressure; Microsensor and Wireless Measurement System Thereof", Thesis for Master Degree of Xiamen University, XU Jinhai May 20, 2010.

Notice of Opposition dated Jul. 7, 2017 in European Patent No. 2477514.

Response to Notice of Opposition filed Mar. 8, 2018 in European Patent No. 2477514.

Examination Decision of Invalidation Request No. 26243 dated Jun. 23, 2015 in Chinese Application or Patent No. 201080003430.9 (or Document Issuance No. 2015061700379090).

Examination Decision of Invalidation Request No. 28219 dated Feb. 6, 2016 in Chinese Application or Patent No. 201080003430.9 (or Document Issuance No. 2016020300672460).

Xu Zhou, "Modern Sensor Technologies", the National Defense Industry Press, Jan. 2007, the 1st Ed. and the 1st Print, Beijing, China.

"Handbook of Flow Measurement", the China Metrology Publishing House, the 1st Ed. Published and First Printed in Feb. 1982 in China.

"Non Contacting Measurement Method and Technology of Pipe Flow", the China Metrology Publishing House, version 1, Published and First Printed in Jan. 1999, in China.

International Search Report for PCT/IB2010/052949 dated Apr. 21, 2011.

Office Action dated Jul. 1, 2013 in Chinese Patent Application No. 201210118301.5.

Office Action dated Mar. 3, 2014 in Chinese Patent Application No. 201210118301.5.

Office Action dated Aug. 13, 2014 in Chinese Patent Application No. 201210118301.5.

Notification to Grant Patent Right for Invention dated Nov. 4, 2014 in Chinese Patent Application No. 201210118301.5.

English Translation of Search Report dated Jun. 24, 2013 in Chinese Patent Application No. 201210118301.5.

English Translation of Search Report dated Jun. 9, 2013 in Chinese Patent Application No. 201210118451.6.

Office Action dated Jun. 28, 2013 in Chinese Patent Application No. 201210118451.6.

Office Action dated Feb. 8, 2014 in Chinese Patent Application No. 201210118451.6.

Office Action dated Jul. 22, 2014 in Chinese Patent Application No. 201210118451.6.

Notification to Grant Patent Right for Invention dated Nov. 24, 2014 in Chinese Patent Application No. 201210118451.6.

English Translation of Search Report dated Dec. 19, 2011 in Chinese Patent Application No. 201080003430.9.

Office Action dated Dec. 23, 2011 in Chinese Patent Application No. 201080003430.9.

Notification to Grant Patent Right for Invention dated Feb. 6, 2012 in Chinese Patent Application No. 201080003430.9.

Office Action dated Jan. 7, 2014 in Japanese Patent Application No. 2012-529362.

Decision to Grant a Patent dated Sep. 30, 2014 in Japanese Patent Application No. 2012-529362.

Extended European Search Report dated Jan. 22, 2015 in European Patent Application No. 10816778.4.

Communication pursuant to Article 94(3) dated Nov. 2, 2015 in European Patent Application No. 10816778.4.

Decision to grant a European patent dated Aug. 25, 2016 in European Patent Application No. 10816778.4.

International Preliminary Report on Patentability dated Mar. 20, 2012 in International Application No. PCT/IB2010/052949.

Non-Final Office Action dated Jun. 30, 2014 in U.S. Appl. No. 13/131,705.

Final Office Action dated Mar. 11, 2015 in U.S. Appl. No. 13/131,705.

Notice of Allowance dated May 20, 2015 in U.S. Appl. No. 13/131,705.

Letter regarding the opposition procedure issued Nov. 16, 2017 in European Patent Application No. 10816778.4.

Summons to attend oral proceedings pursuant to Rule 115(1) issued on Sep. 3, 2018 in European Patent Application No. 10816778.4.

Administrative Written Judgment issued Dec. 18, 2018 in Chinese Patent No. 201080003430.9.

Brief Communication dated Feb. 8, 2019 regarding Letter from the Opponent filed Feb. 1, 2019 in European Application No. 10816778.4.

Datasheet for Honeywell AWM 2100V Airflow Sensor, "Installation Instructions for the AWM2000 Series", Issue 3 PK 88544, (2003).

Non-Final Office Action dated Jan. 17, 2018 issued in U.S. Appl. No. 14/793,453.

Notice of Allowance dated Aug. 13, 2018 issued in U.S. Appl. No. 14/793,453.

Notice of Allowance dated Jun. 7, 2019 issued in U.S. Appl. No. 14/793,453.

(56) References Cited

OTHER PUBLICATIONS

"Non-contact Measurement of Pipe Flow—Method and Technology," pp. 206-218, 2000.
Ji, Liu, et al., "Medical Electronics," pp. 256-266 and English translation.
Chinese Examination Decision of the Patent Reexamination Board.
Chinese Administrative Judgement made by the Beijing Higher Court (No. 2019-4330) with respect to the No. 28219 Examination Decision for Invalidation Request.
Chinese Invalidation Request against Chinese Patent No. 201080003430.9 dated Oct. 14, 2022.
Minping, J. et al., "Measurement Technology," Mechanical Design and Manufacturing and Its Automation Series of professional textbooks, Dec. 2015 and English translation.
"Flow Measurement Handbook," pp. 234-255, 2009.
Decision in Opposition proceedings (Art. 101(3)(a) and 106(2) EPC) issued Jun. 4, 2019 in European Patent No. 2 477 514.
Minutes of the oral proceedings in accordance with Rule 124(4) EPC issued Jun. 4, 2019 in Opposition of European Patent No. 2 477 514.
Invitation to file Observations and the opponent's grounds of appeal issued Oct. 25, 2019 in Appeal No. T2244/19-3.2.01 of Opposition of European Patent No. 2 477 514.
Wikipedia "Baffle" (heat Transfer) introduced on Oct. 14, 2019 in Appeal No. T2244/19-3.2.01 of Opposition of European Patent No. 2 477 514.
Notification of Acceptance of Request for Invalidation dated Oct. 30, 2020 in Chinese Patent No. 201080003430.9.
Appeal Decision issued Jul. 28, 2021 in European Application No. 10816778.4.
Judgement of the Beijing Higher People's Court issued Sep. 25, 2020 in Chinese Application No. 201080003430.9.
Preliminary Opinion on Appeal issued Oct. 9, 2020 in European Patent No. 2 477 514.
Summons to oral proceedings pursuant to Rule 115(1) issued Jun. 24, 2020 in European Patent No. 2 477 514.
Peter Elgar, "Sensors for Measurement and Control" China Machine Press, 2007.
"AWM6422 Power amplifier" published on *Sensor World* on Mar. 15, 2008, [retrieved from http://cnki.net].
"Application of PTB220 Air Pressure Sensor in Air Pressure Measurement" published on China Metrology in Mar. 2008, [retrieved from http://cnki.net].
"Illustrations of Sensor Technology and Application Circuit (ISBN 978-7-5083-8559-4)," published by the China Electric Power Press in Aug. 2009, pp. 21-30.
Minutes of the oral proceedings issued Jun. 24, 2021 in European Application No. 10816778.4.
Chinese Examination Decision for the Invalidation Request for Chinese Application No. 201080003430.9 mailed Dec. 29, 2023.

* cited by examiner

ELECTRONIC SMOKE APPARATUS

This application is a continuation of U.S. application Ser. No. 14/793,453, filed on Jul. 7, 2015, which is a continuation-in-part of U.S. application Ser. No. 13/131,705, filed on May 27 2011, which is a U.S. National Phase entry application of PCT Application No. PCT/IB2010/052949, filed Jun. 29, 2010, which claims priority to Chinese Application No. 2009201793166, filed Sep. 18, 2009, the entire contents of each of which are incorporated herein by reference.

Electronic smoke apparatus are electronic substitutes of their conventional tobacco burning counterparts and are gaining increasing popularity and acceptance.

Electronic smoke apparatus are usually in the form of electronic cigarettes or electronic cigars, but are also available in other forms. Typically electronic smoke apparatus comprise a rigid housing and a battery operated vaporizer which is to operate to excite a flavoured source to generate a visible and flavoured vapour. The flavoured vapour is delivered to a user in response to suction of the user at a smoke outlet on the rigid housing of the smoke apparatus to simulate smoking.

In this specification, the terms electronic smoke and electronic smoke apparatus are interchangeable and includes electronic smoke apparatus which are known as electronic cigarettes, electronic cigar, e-cigarette, personal vaporizers etc., without loss of generality.

Figure 1A:
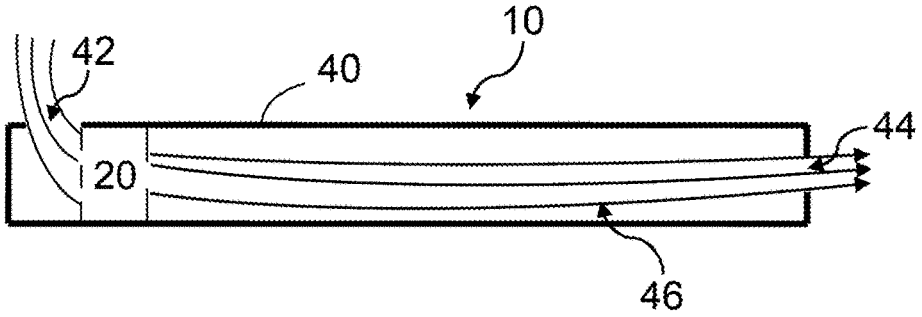
Figure 2:
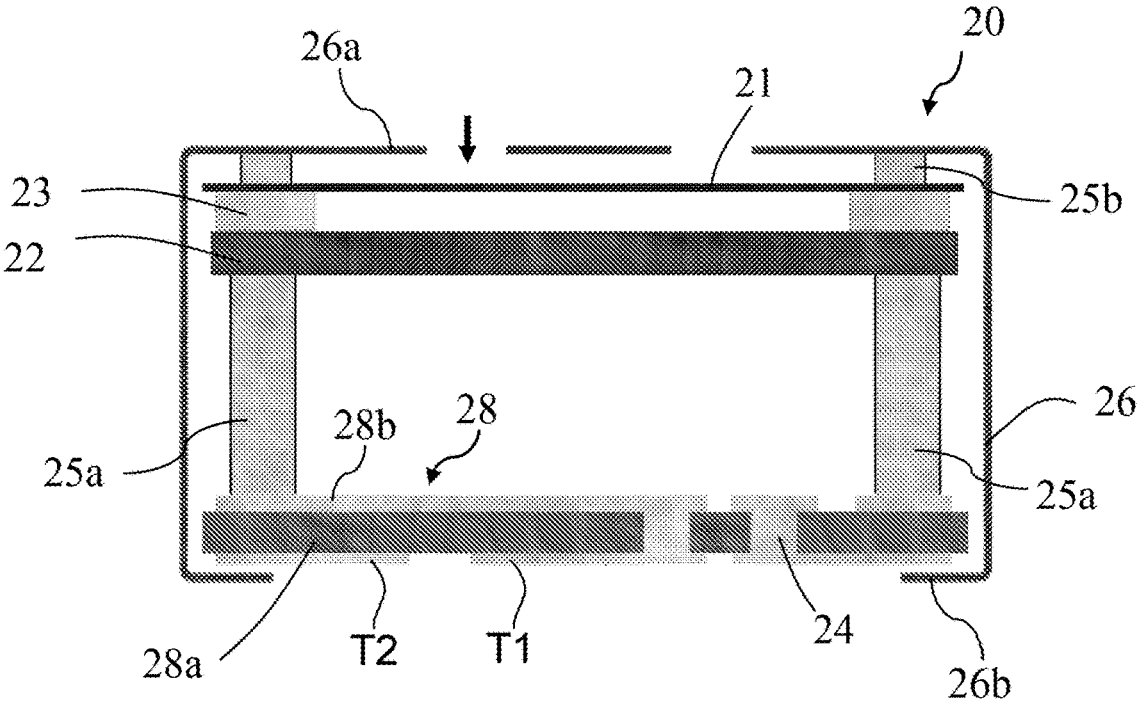
Figure 3:
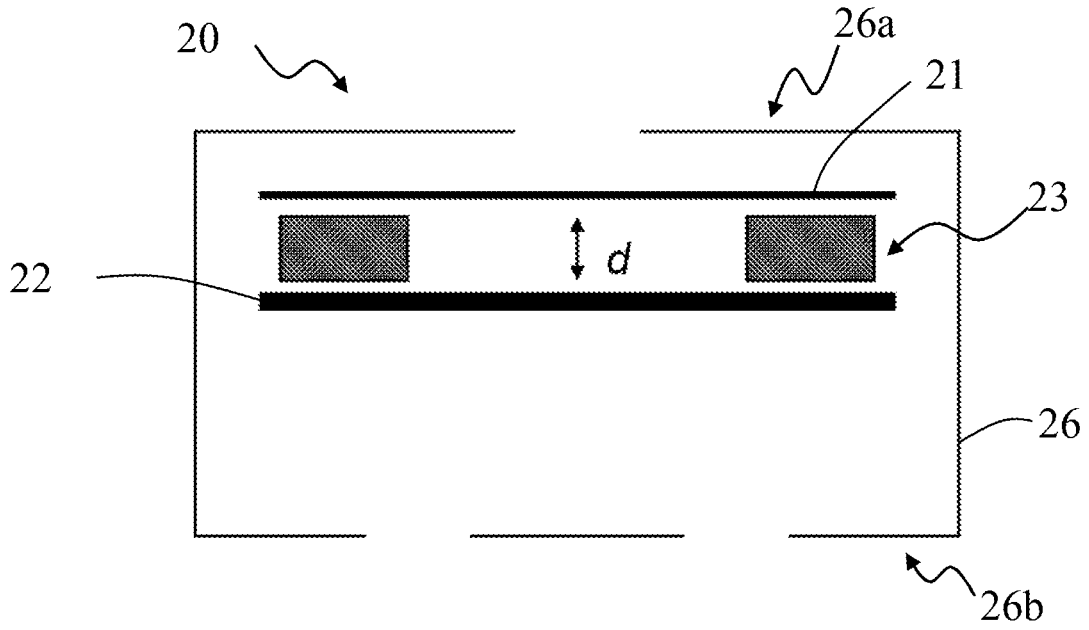
Figure 3A:
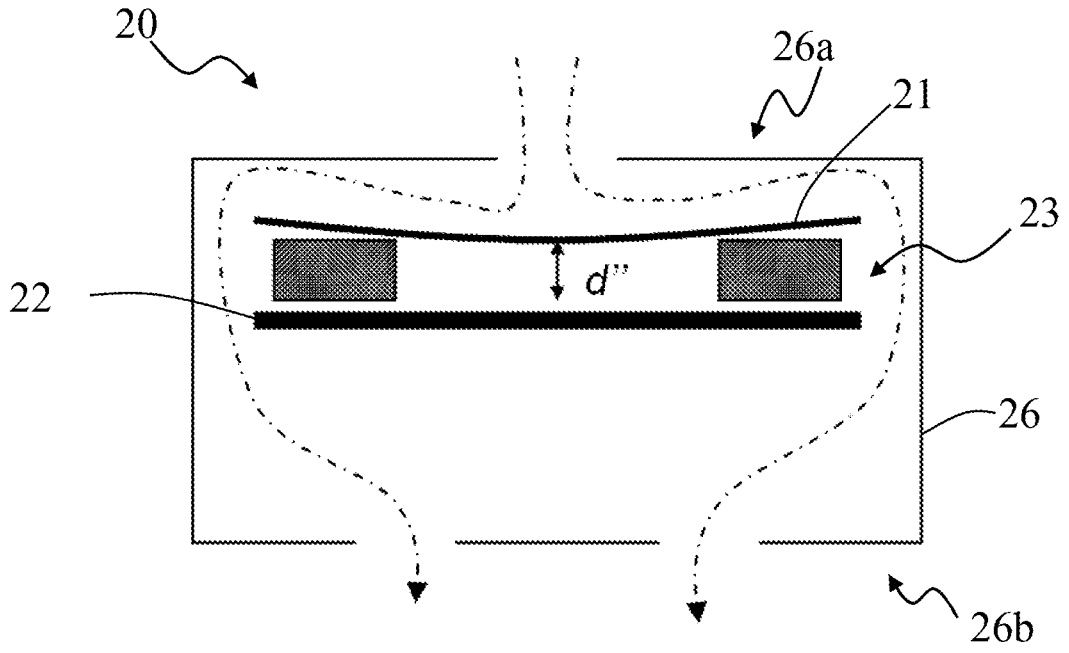
Figure 3B:
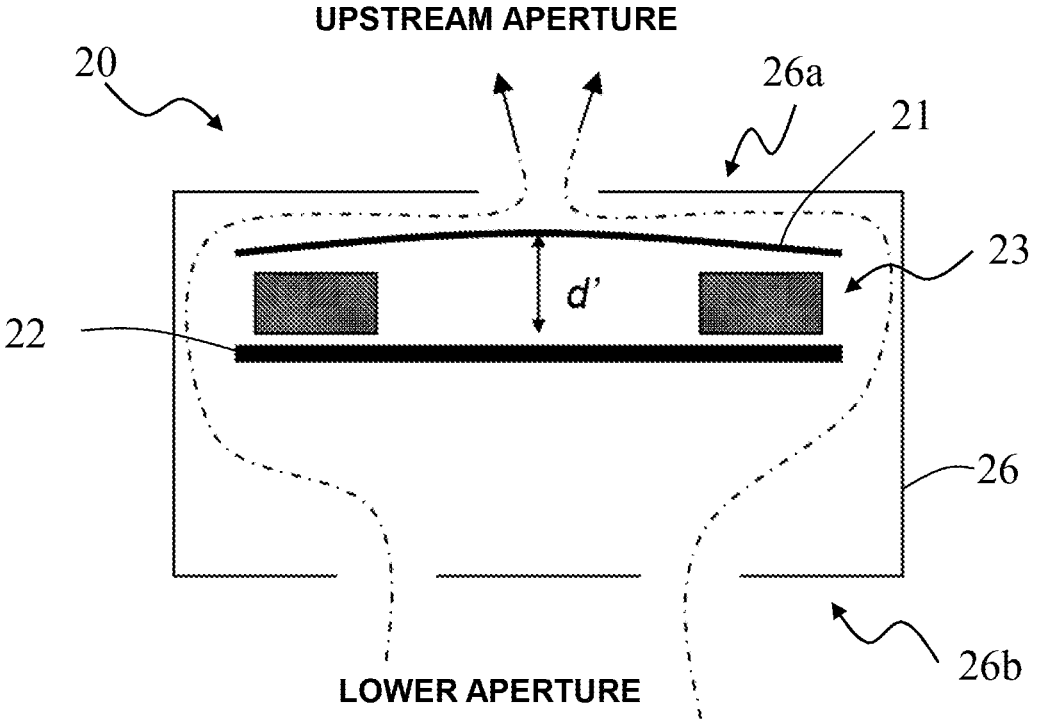
Figure 4A:
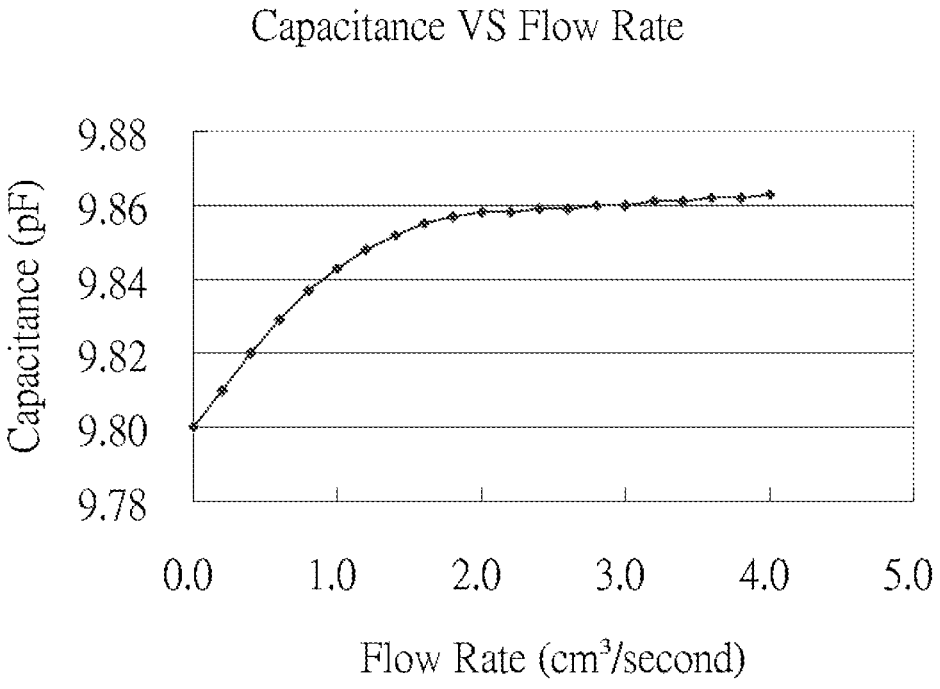
Figure 4B:
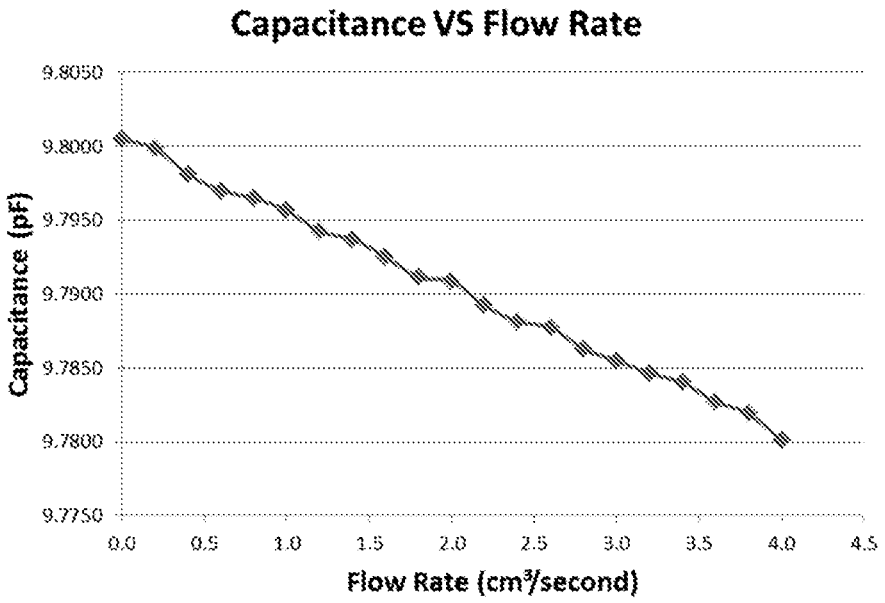
Figure 5:
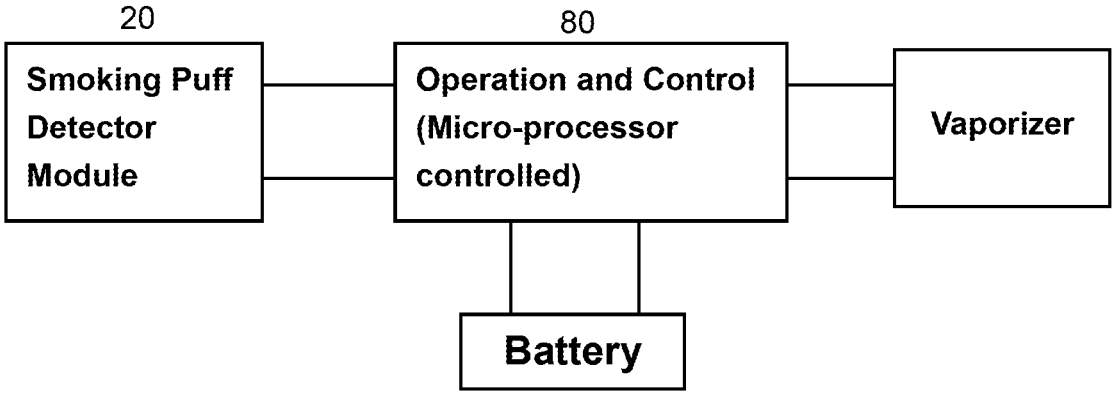
Figure 6A:
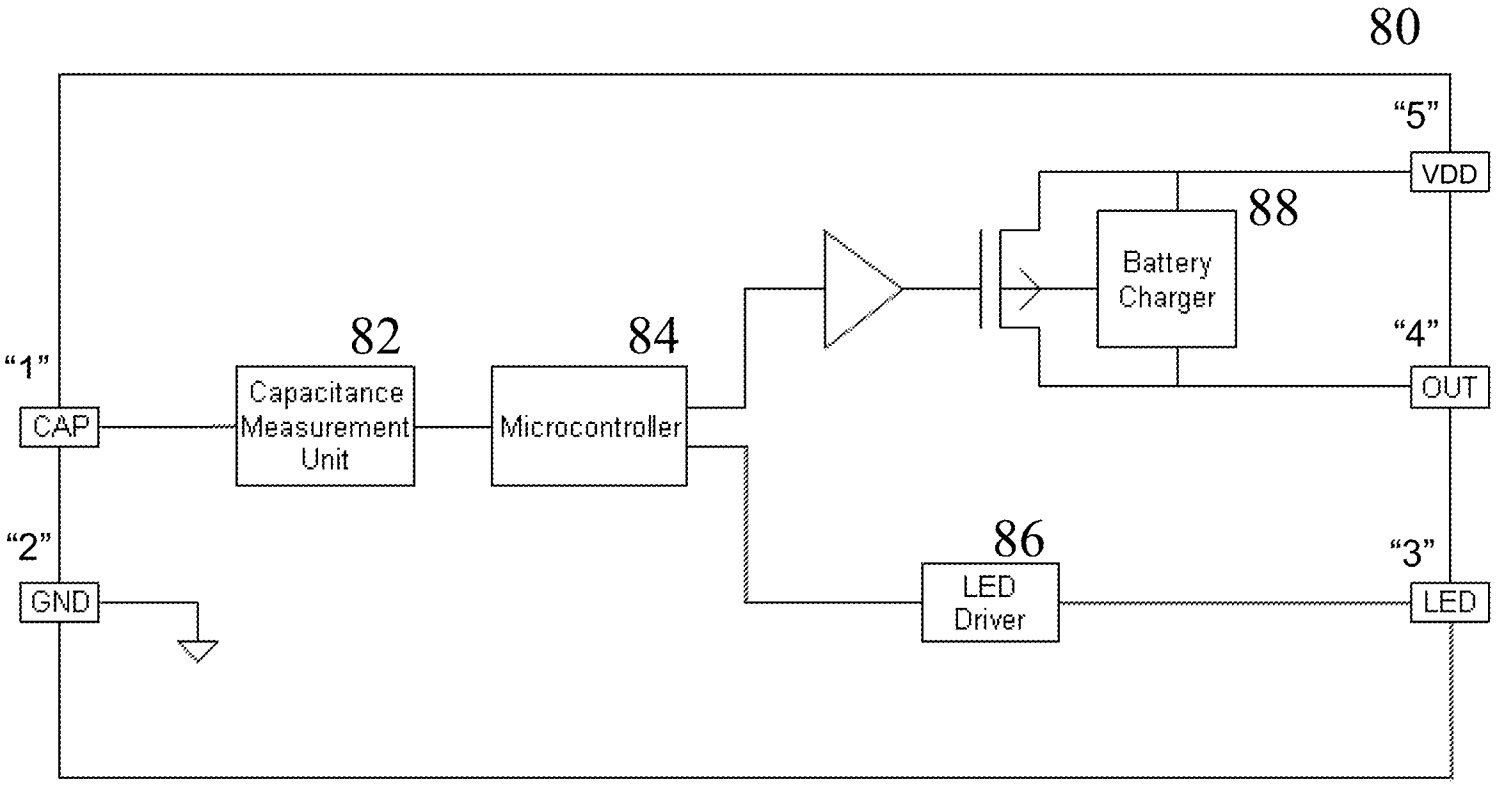
Figure 6B:
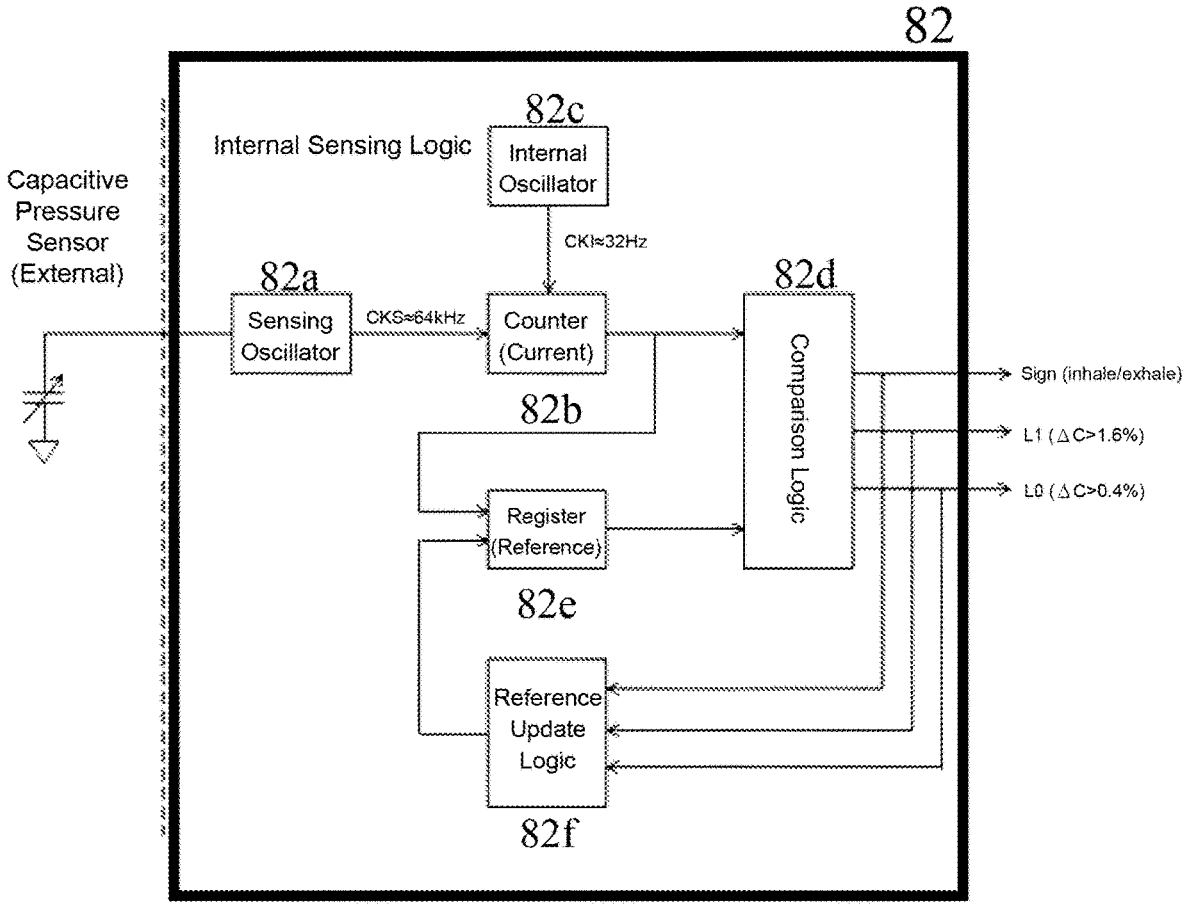
Figure 7:
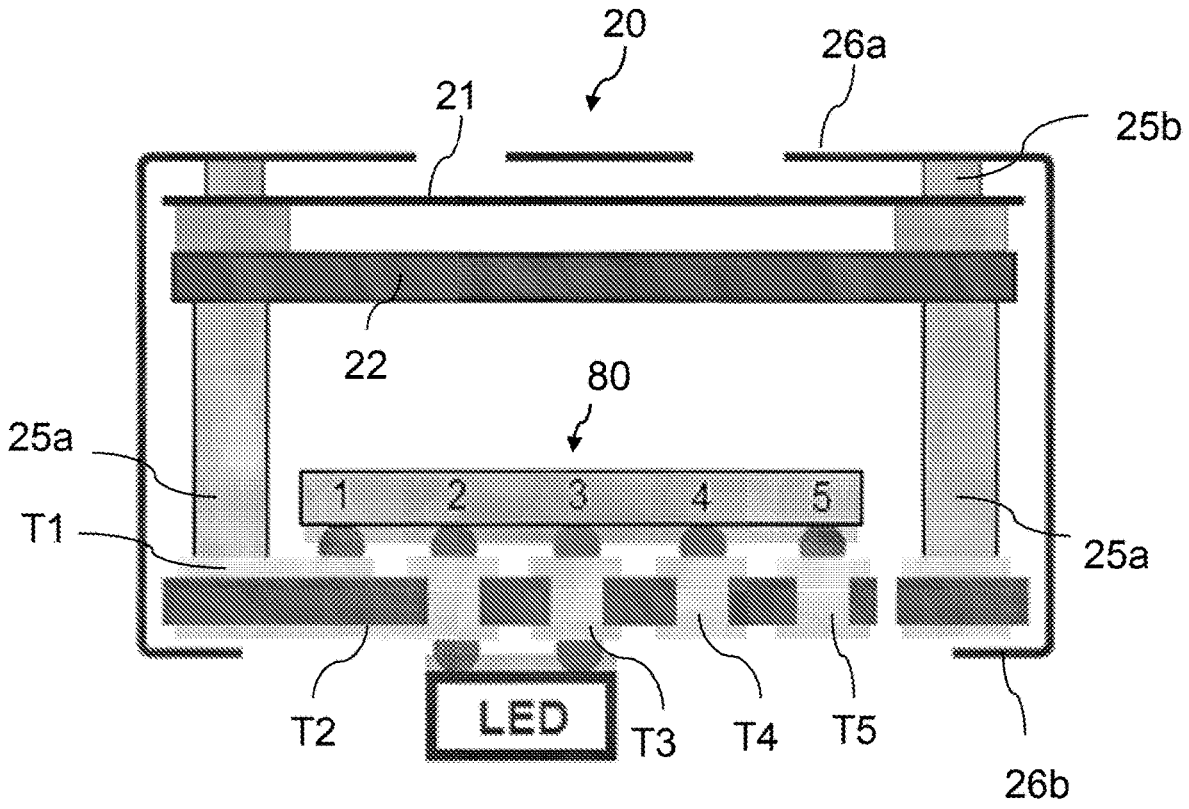
Figure 8A:
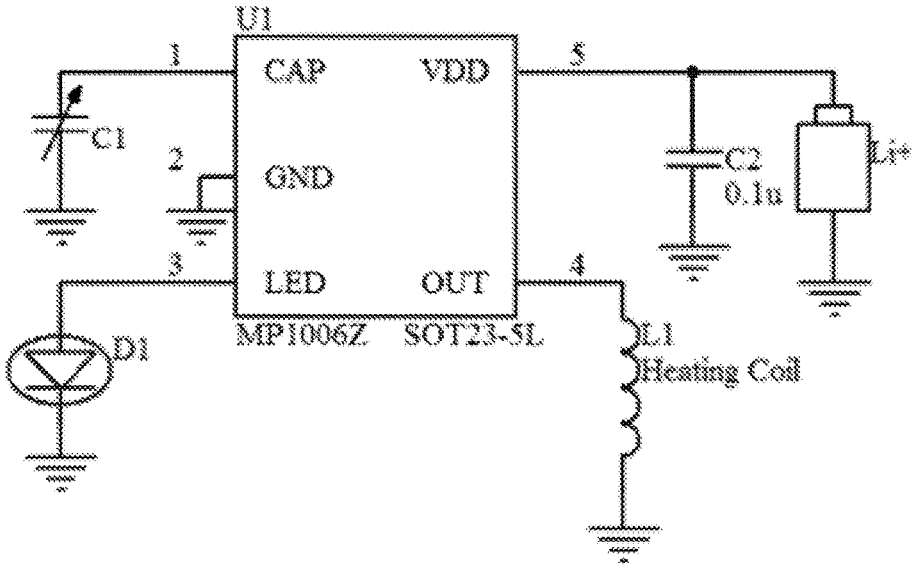
Figure 8:
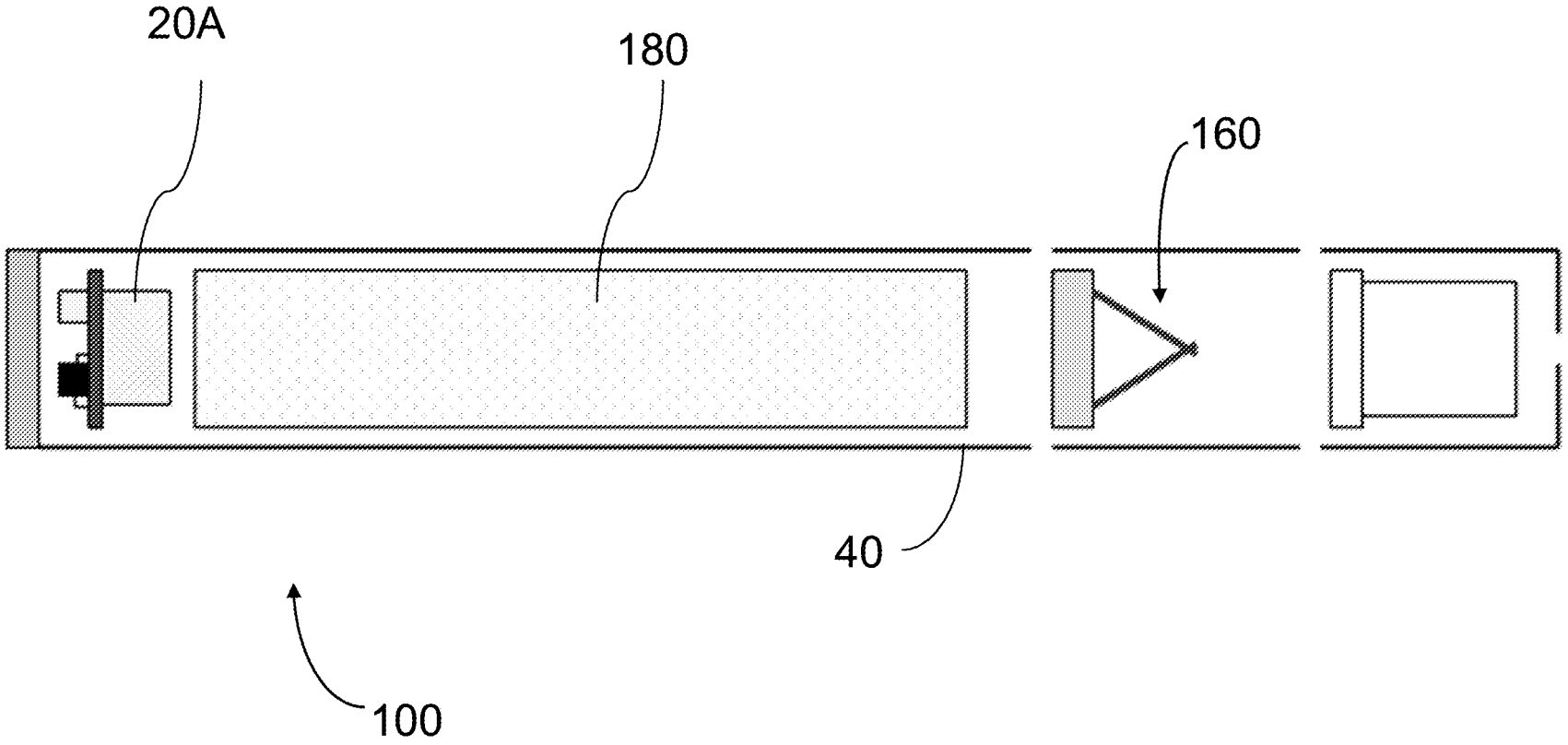
Figure 9A:
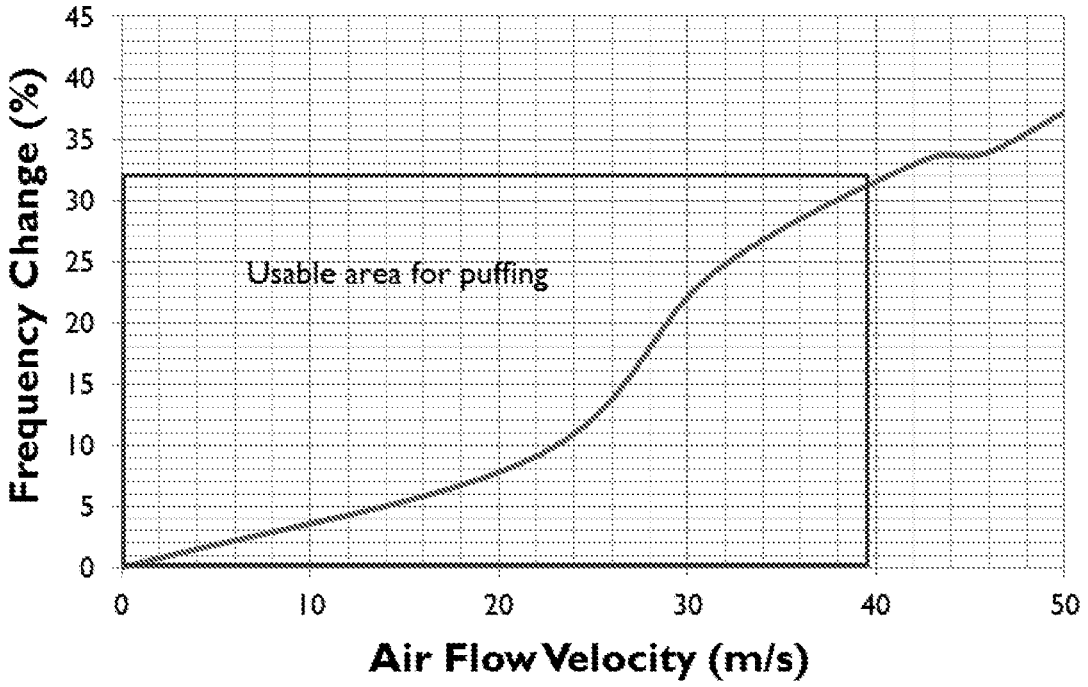
Figure 9B:
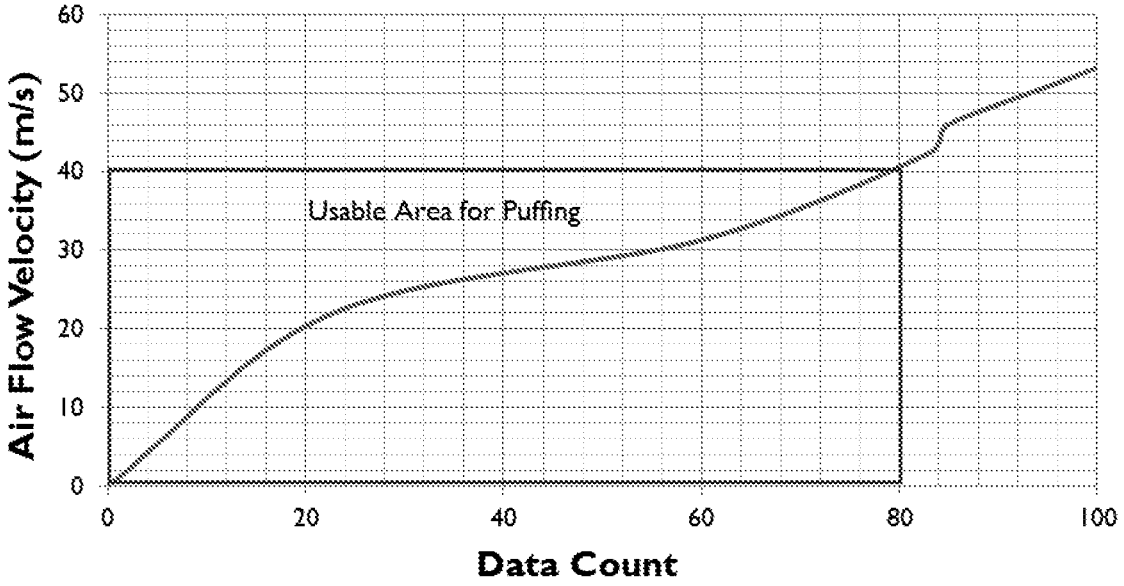
Figure 9C:
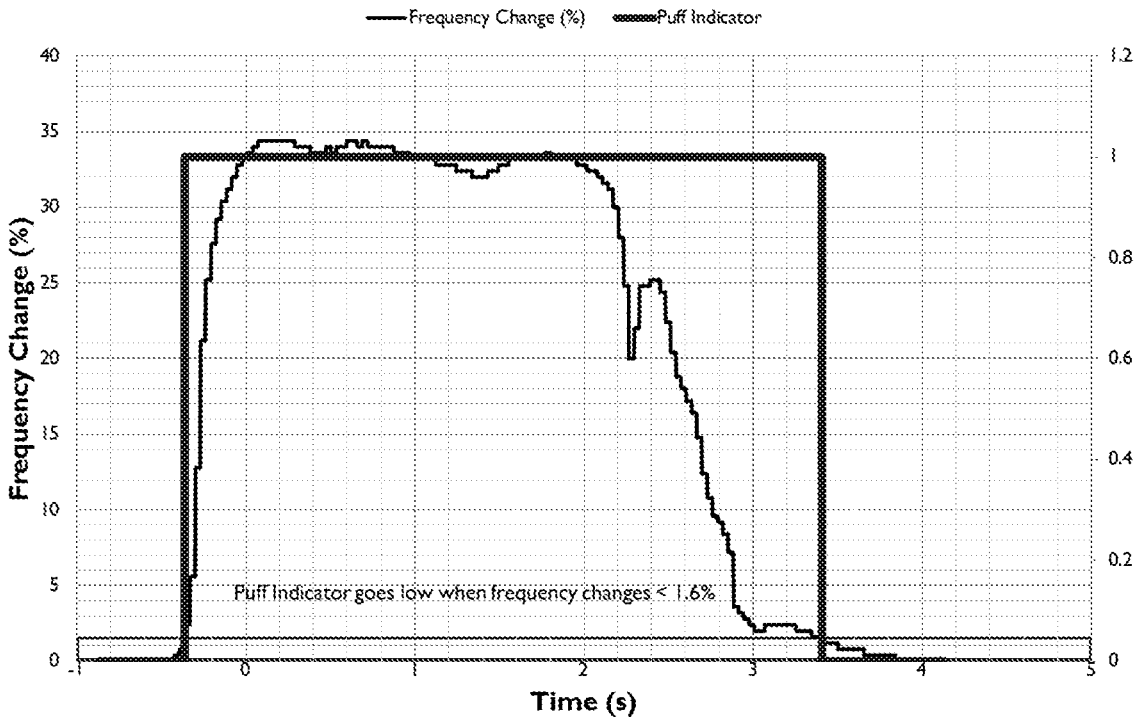
Figure 9D:
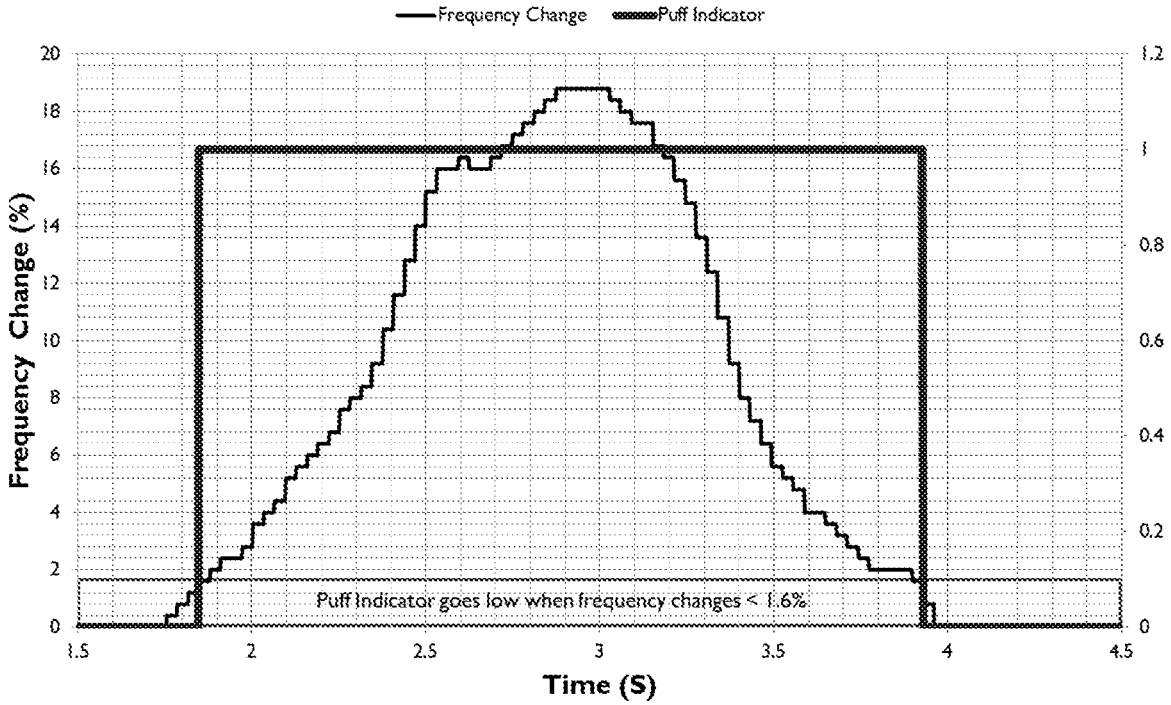
Figure 9E:
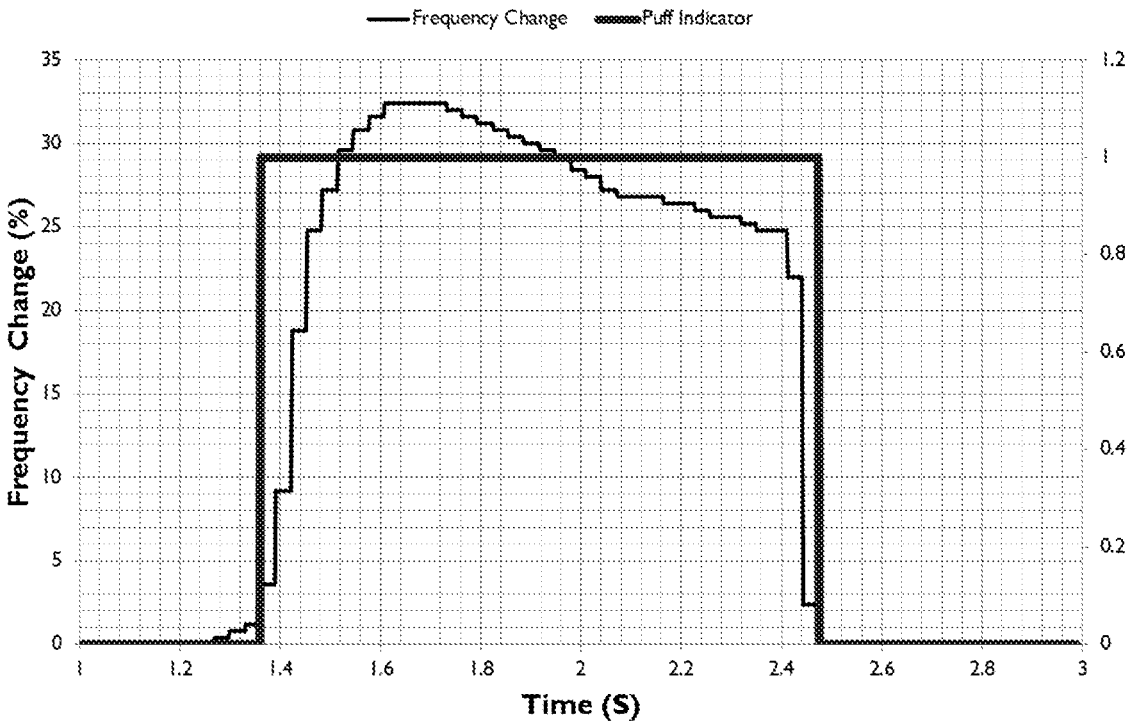
Figure 9F:
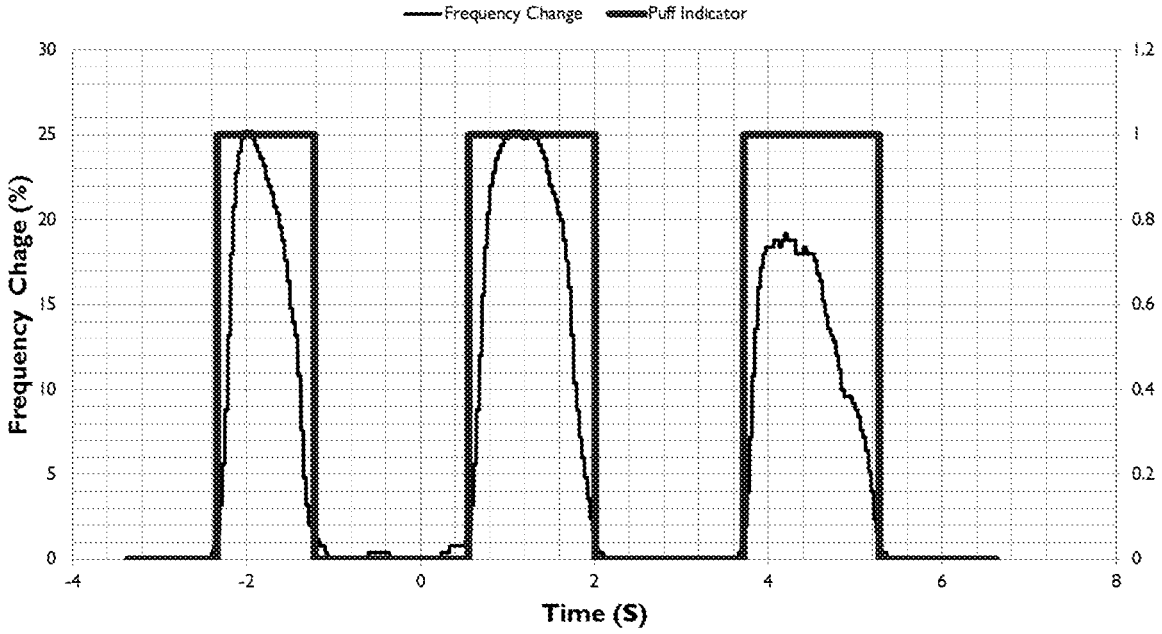
Figure 9G:
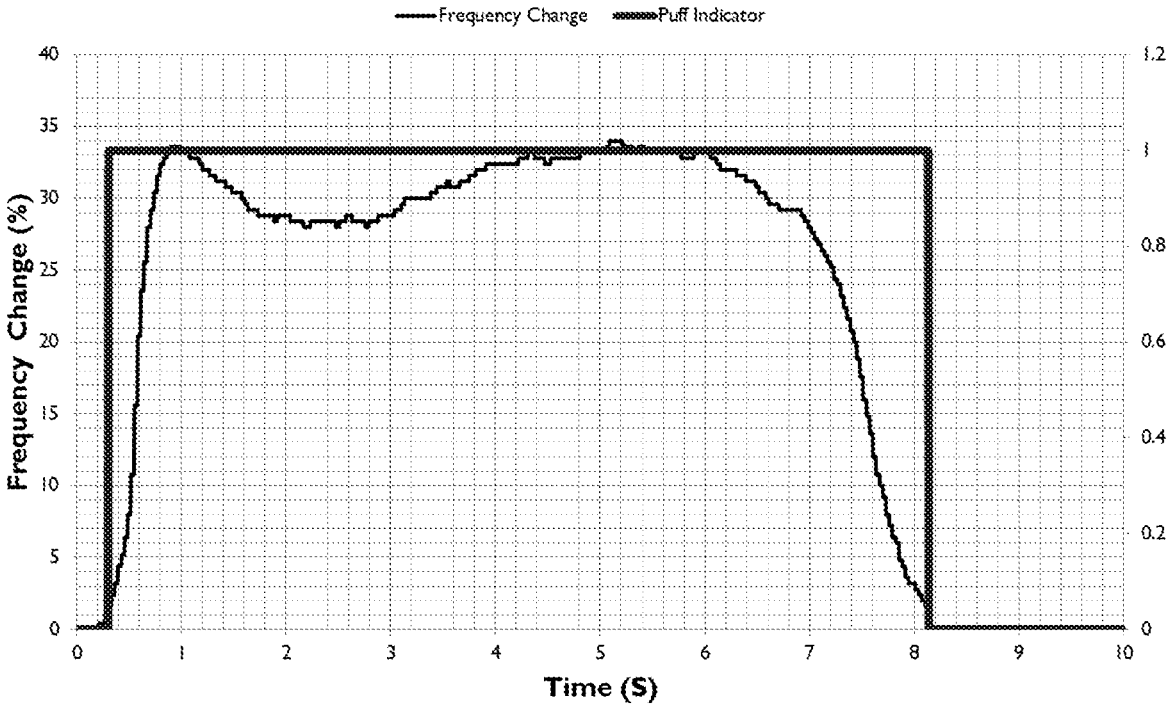
Figure 9H:
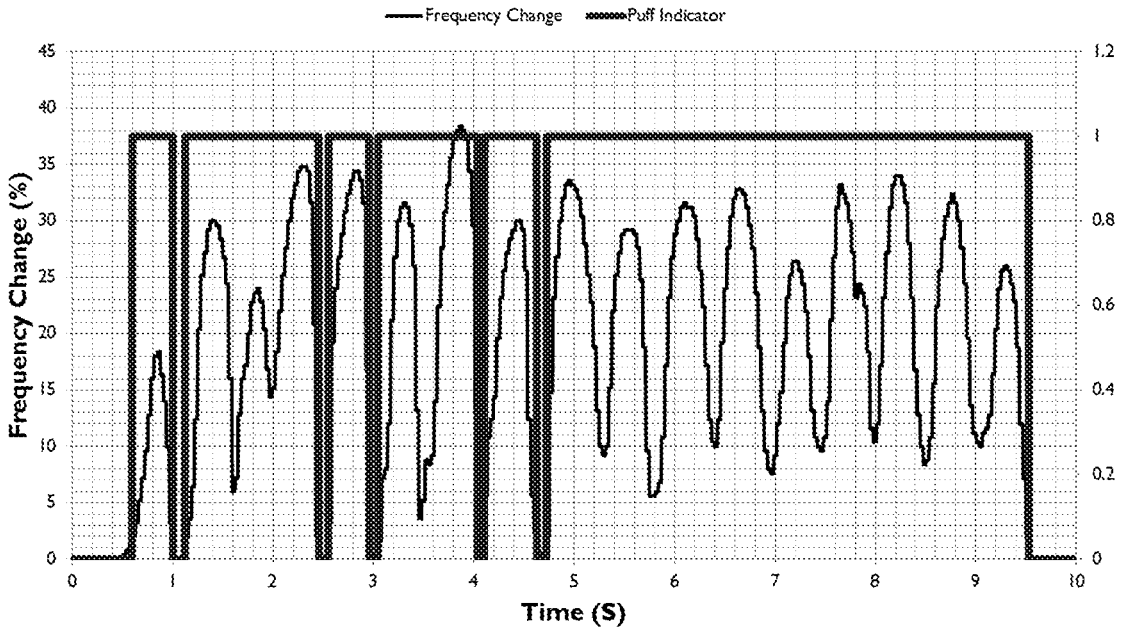
Figure 10A:
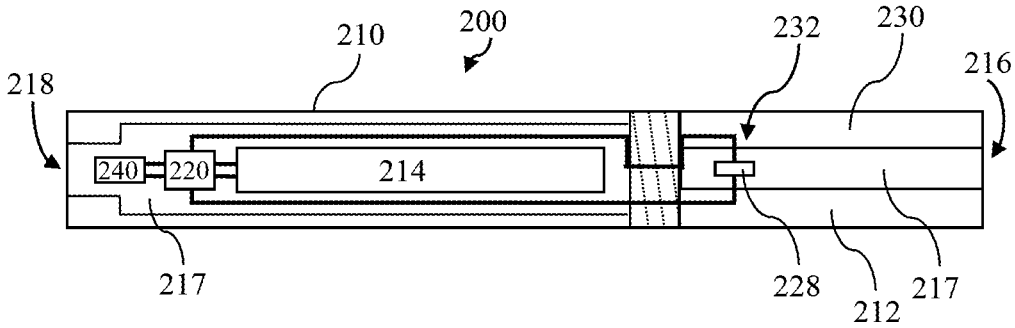
Figure 10B:
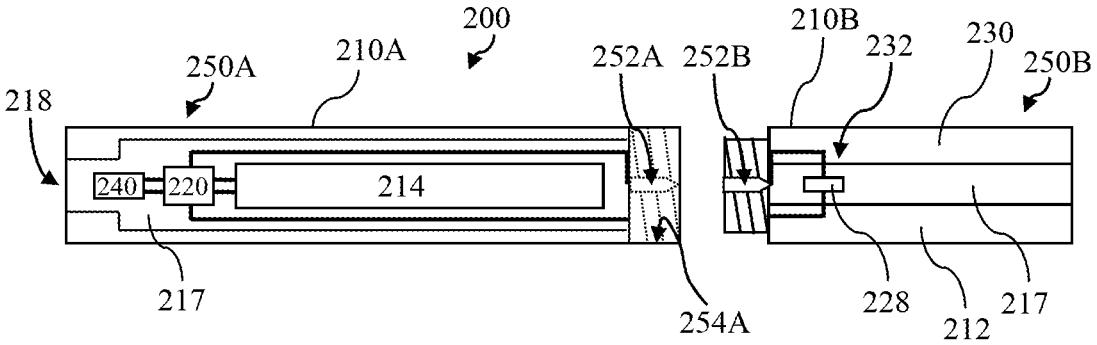
Figure 10C:
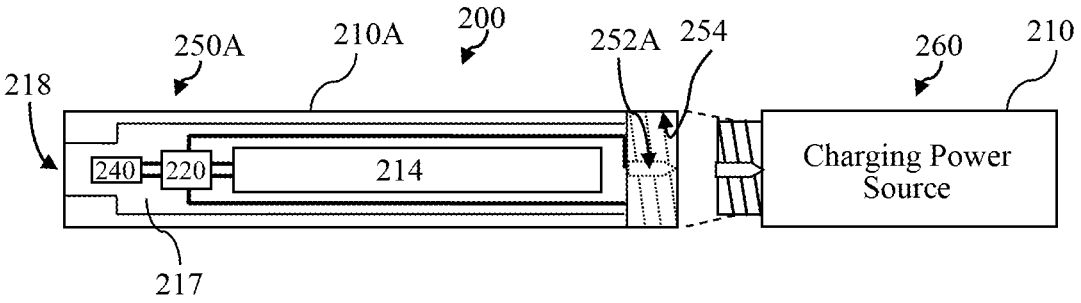
Figure 11A:
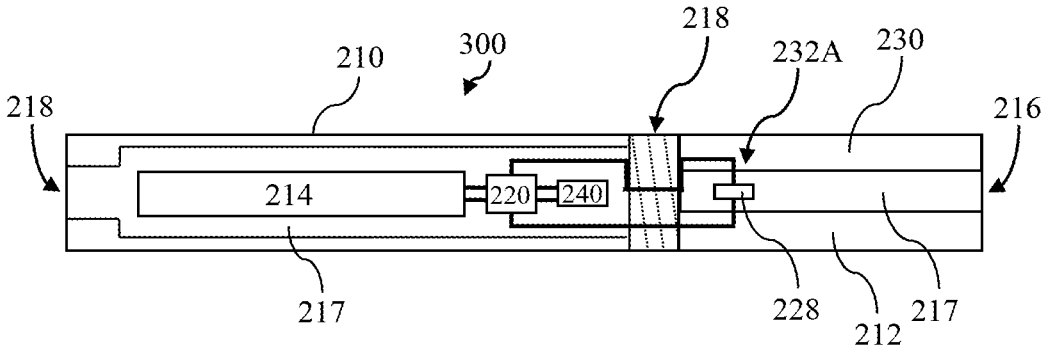
Figure 12:
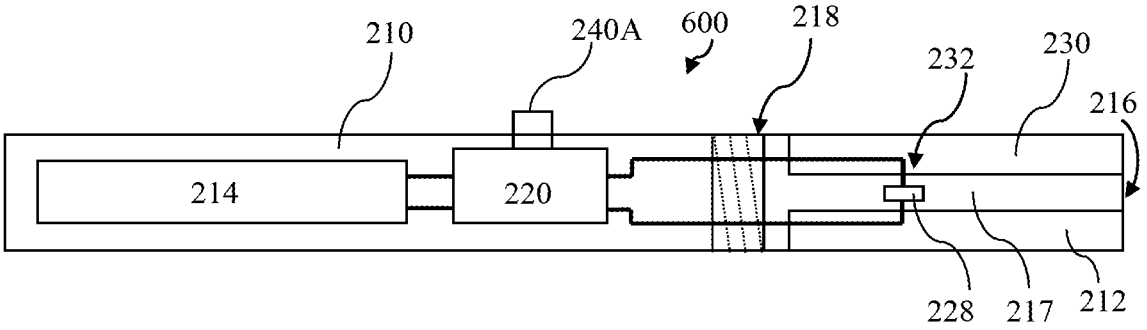

The present disclosure will be described with reference to the accompanying drawings, in which:

FIG. 1 is a schematic diagram of an example electronic cigarette according to the present disclosure, FIG. 1A depicts schematically the example electronic cigarette of FIG. 1 during example operations, FIG. 2 is a schematic diagram showing an example smoking puff detection module of the example electronic cigarette of FIG. 1, FIG. 3 is a schematic diagram depicting the example puff detection sub-assembly of the smoking puff detection module of FIG. 2 in a stand-by mode, FIG. 3A is a schematic diagram depicting a first example operation mode of the smoking puff detection module when air flows in a first direction through the smoking puff, FIG. 3B is a schematic diagram depicting a second example operation mode of the smoking puff detection module when air flows in a second direction opposite to the first direction through the smoking puff, FIG. 4A is a diagram depicting example relationship between characteristic capacitance value of the puff detection sub-assembly of FIG. 3 and air flow rate when operating in the first example operation mode of FIG. 3A, FIG. 4B is a diagram depicting example relationship between characteristic capacitance value of the puff detection sub-assembly of FIG. 3 and air flow rate when operating in the second example operation mode of FIG. 3B, FIG. 5 is a schematic diagram depicting electronic circuitry of the example electronic cigarette of FIG. 1, FIG. 6A is a schematic diagram of an example operation and control device of FIG. 5, FIG. 6B is a schematic diagram of an example capacitance measurement device of FIG. 5A, FIG. 7 is a schematic diagram showing an example smoking puff detection and actuation module, FIG. 8 shows an example electronic smoke comprising a smoking puff detection and actuation module of FIG. 7, FIG. 8A is a schematic diagram of electronic arrangement of the example electronic smoke of FIG. 8, FIG. 9A depicts example relationship between oscillation frequency change and airflow rate entering the example electronic smoke, FIG. 9B shows example relationship between airflow rate entering the example electronic smoke and data count of the data counter, FIG. 9C to 9H show relationship different smoking inhaling behavior and actuation time of the vaporizer, FIGS. 10A to 10C depicts example electronic smokes, FIGS. 11A to 110 depicts example electronic smokes, and FIG. 12 show another example electronic smoke.

DETAILED DESCRIPTION OF EXEMPLARY EMBODIMENTS

An electronic smoke 10 comprising a battery powered smoking puff detection module 20 and a rigid main housing 40 is depicted in FIGS. 1 and 1A. The smoking puff detection module 20 is installed inside the main housing 40 at a location downstream of and proximal the air inlet 42. A battery for operating the electronic smoke 10, an operation and control device 80 and a battery operable vaporizer and a source of flavouring substances are installed inside the air passageway 46 of the main housing while leaving an airflow path for air to move from the air inlet 42 to the air outlet 44.

The rigid main housing 40 is elongate and defines an air inlet 42, an air outlet 44 and an air passageway 46. The air inlet 42 is at a first longitudinal end of the rigid main housing 40 and is in the form of an aperture on one lateral side of the main housing 40, the air outlet 44 is at a second longitudinal end of the rigid housing distal from the first longitudinal end, and the air passageway 46 defines an airflow path to interconnect the air inlet 42 and the air outlet 44.

The elongate main housing 40 is tubular and has a generally circular cross section to resemble the shape and size of a conventional paper and tobacco cigarette or cigar. The air outlet 44 is formed at an axial end of the longitudinally extending main housing 40 to function as a mouth piece during simulated smoking use or operations by a user.

A transparent or translucent cover is attached to a longitudinal end of the rigid main housing 40 distal to the inhaling end or air outlet end so that an operation indicator such as an LED is visible.

During simulated smoking operations, a user will apply a suction puff at the mouth piece of the electronic smoke. The suction puff will induce an air flow to flow from the air inlet 42 to exit at the air outlet 44 after passing through the air passageway 46, as depicted schematically in FIG. 1A.

An example battery powered smoking puff detection module 20 (the "Smoking Puff Detection Module") depicted in FIG. 2 comprises a first conductive plate member 21 and a second conductive plate member 22 which are held in a spaced apart manner by an insulating ring spacer 23. The puff detection sub-assembly, comprising the first conductive plate member 21, the second conductive plate member 22 and the insulating ring spacer 23, is held inside a metallic module casing 26 by a holding structure to form a modular assembly. The holding structure includes a first holding ring 25*a*, a second holding ring 25*b*, and a rigid base plate member 28. The first holding ring 25*a* supports the detection subassembly on the rigid base plate member 28 and elevates the second conductive plate member 22 from the rigid base plate member 28 towards ceiling portion 26*a* of the metallic module casing 26. The second holding ring 25*b* is a centrally punctured or centrally apertured disk having a peripheral flange diameter comparable to that of the ring spacer 23. The second holding ring 25*b* is positioned between the first conductive plate member 21 and the ceiling of the metallic module casing 26 and to cooperate with other components of the holding structure and the metallic module casing 26 to exert an axial holding force along the periphery of the first conductive plate member 21 to hold the first conductive plate member 21 in place inside the metallic module casing 26.

The rigid base plate member 28 is held by a floor portion 26*b* of the metallic module casing 26 which is in the form of a metallic can and comprises a printed circuit board ("PCB") having an insulating substrate board 28*a* on which conductive tracks such as copper tracks 28*b* are formed. The metallic can of the metallic module casing 26 includes a radial floor portion 26*b* which extends radially inwards along the circumference of the metal can to define a clamping device to cooperate with the ceiling portion 26*a* to hold the holding structure and the detection subassembly firmly in place inside the metal can.

A plurality of contact terminals is formed on the PCB. The contact terminals include a first terminal ("T1") which is connected to the second conductive plate member 22 through the conductive first holding ring 25*a* and a second terminal ("T2") which is connected to the first conductive plate member 21 by means of the metal can casing and the conductive second holding ring 25*b*.

The example first conductive plate member 21 comprises a flexible and conductive membrane which is under lateral or radial tension and spans across a central aperture defined by the ring spacer 23 under radial tensions. The flexible and conductive membrane of the first conductive plate member 21 is disposed at a small distance from both the ceiling of the metal can and the second conductive plate member 22. The separation distance between the flexible membrane and the second conductive plate member 22 allows the flexible membrane to deform axially towards the second conductive plate member 22 when there is an axial airflow which flows from the ceiling towards the second conductive plate member 22. The separation distance between the flexible membrane and the ceiling portion 26*a* of the metal can allows the flexible membrane to deform axially towards the ceiling of the metal can when there is an axial airflow which flows from the second conductive plate member 22 towards the ceiling. The flexible and conductive membrane is resiliently deformable in the axial direction and will return to its neutral axial state when axial airflow stops. The axial direction is aligned with the axis of the central aperture defined by the ring spacer and is orthogonal or substantially orthogonal to the radial or lateral direction.

A plurality of apertures is distributed on the ceiling portion of the metal can to allow air flow to move into or out of the metal can through the ceiling portion. At least an aperture is formed through the PCB to allow air flow to move into or out of the metal can through the floor portion.

The second conductive plate member 22 comprises a rigid conductive or metal plate which is to function as a reference conductive plate to facilitate detection of axial deflection or deformation of the first conductive plate member 21. A plurality of apertures is formed on the second conductive plate member 22 to allow air to flow across the second conductive plate member 22 while moving through an air chamber defined between the ceiling 26*a* and floor 26*b* of the metal can.

When the puff detection sub-assembly is at a neutral or stand-by mode or state as depicted in FIG. 3, the first conductive plate member 21 is un-deformed or substantially un-deformed. When in this state, the first conductive plate member 21 and the second conductive plate member 22 are parallel and the separation distance d between the first conductive plate member 21 and the second conductive plate member 22 is constant or substantially constant.

When air moves from an aperture on the ceiling portion 26*a* of the metal can 26 towards an aperture on the floor portion 26*b* of the metal can as depicted in FIG. 3A, the central portion of the first conductive plate member 21 which is above the central aperture of the spacer ring 23 will be deformed. As the first conductive plate member 21 is held firmly in place by the second holding ring 25*b*, the central portion of the first conductive plate member 21 will deflect and bulge in a direction towards the second conductive plate member 22. When this happens, the separation distance d" between the first 21 and the second 22 conductive plate members will decrease compared to that of the un-deformed state, with a maximum decrease occurring at the central portion and no decrease at the portion which is in abutment with the spacer ring 23. As a rough estimation, the average separation d along the width or diameter of the central portion can be taken as an effective separation distance between the first 21 and the second 22 conductive plate members.

When air moves from an aperture on the floor portion 26*b* of the metal can towards an aperture on the ceiling portion 26*a* of the metal can 26 as depicted in FIG. 3B, the central portion of the first conductive plate member 21 which is above the central aperture of the spacer ring 23 will be deformed. As the first conductive plate member 21 is held firmly in place by the second holding ring 25*b*, the central portion of the first conductive plate member 21 will deflect and bulge in a direction away from the second conductive plate member 22. When this happens, the separation distance d' between the first 21 and the second 22 conductive plate members will increase compared to that of the un-deformed state, with a maximum increase occurring at the central portion and no increase at the portion which is in abutment with the spacer ring 23. As a rough estimation, the average separation d along the width or diameter of the central portion can be taken as an effective separation distance between the first 21 and the second 22 conductive plate members.

The first conductive plate member 21, the second conductive plate member 22 and the insulating ring spacer 23 of the puff detection sub-assembly of FIGS. 2 and 3 can be regarded as cooperating to define a dielectric capacitor having a capacitance value $C=\varepsilon A/d$, where $\varepsilon$ is dielectric constant of the separation or spacing medium, A is the effective overlapping or opposing surface area of the first conductive plate member 21 and the second conductive plate member 22, and d is the effective separation distance between the first and second conductive plate members. The capacitive properties or characteristics of the puff detection sub-assembly and their change when subject to airflow deformation would be readily apparent from FIGS. 4A and 4B. In an example puff detection sub-assembly having the capacitance characteristics depicted in FIGS. 4A and 4B, the sub-assembly of the first conductive plate member 21 and the second conductive plate member 22 has an effective capacitance diameter of 8 mm and a separation distance d of 0.04 mm when at the stand-by state of FIG. 3. The capacitance value of this sub-assembly is about 10 pF. In another example puff detection sub-assembly also having the capacitance characteristics depicted in FIGS. 4A and 4B, the sub-assembly of the first conductive plate member 21 and the second conductive plate member 22 has an effective capacitance diameter of 3.5 mm and a separation distance d of 25 μm when at the stand-by state of FIG. 3. The capacitance value of this sub-assembly is also about 10 pF.

When air flows through the puff detection sub-assembly in the manner as shown in FIG. 3A, the first conductive plate member 21 will deflect and bulge in a direction towards the second conductive plate member 22. The effective separation distance d" will decrease and the effective capacitance value C" of the capacitor defined by the spaced apart first and second conductive plate members will increase as depicted in FIG. 4A. The extent of change of effective separation distance and capacitance value is dependent on the air-flow rate as shown in FIG. 4A. On the other hand, when air flows through the puff detection sub-assembly in an opposite direction as shown in FIG. 3B, the first conductive plate member 21 will deflect and bulge in a direction away from the second conductive plate member 22. The effective separation distance d' will increase and the effective capacitance value C' of the capacitor defined by the spaced apart first and second conductive plate members will decrease as depicted in FIG. 4B. Likewise, the extent of change of effective separation distance and capacitance value is dependent on the air-flow rate as shown in FIG. 4B. The capacitance value of the dielectric capacitor of the puff detection sub-assembly can be measured and utilised by taking electrical measurements across the terminals T1 and T2 on the PCB of FIG. 2.

In some embodiments, the first conductive plate member 21 is a flexible and resilient conductive membrane made of metal, carbonised or metalized rubber, carbon or metal coated rubber, carbonised or metalized soft and resilient plastic materials such as a PPS (Polyphenylene Sulfide), or carbon or metal coated soft and resilient plastic materials.

In some embodiments, the flexible and resilient conductive membrane is tensioned in the lateral or radial direction to detect air flows in an axial direction. An axial air flow is one which is orthogonal or substantially orthogonal to the surface of the first conductive plate member 21.

Due to resilience of the flexible and resilient conductive membrane, the membrane will return to its neutral condition of FIG. 3 when the air flow stops or when the air-flow rate is too low to cause deflection or deformation of the membrane.

In some embodiments, the metal can 26 is made of steel, copper or aluminium.

In some embodiments, the second conductive plate member is a rigid and perforated metal plate made of steel, copper or aluminium.

An example electronic arrangement of the electronic smoke of FIG. 1 comprises a smoking puff detection module 20, an operation control circuit 80, a vaporizer and a battery as depicted in FIG. 5. The smoking puff detection module 20 is connected to the operation control circuit 80 so that the operation control circuit 80 can monitor the operation state at the electronic smoke and operate the vaporizer to generate simulated smoking effects when simulated activities are detected.

An example operation control circuit 80 is depicted in FIG. 6A. The example operation control circuit 80 comprises a capacitance measurement unit 82. Output of the capacitance measurement unit 82 is connected to the input of a microprocessor or microcontroller 84. The microcontroller 84 includes a first output which is connected to an LED driver 86 for driving LED (light emitting diode) and a second output which is connected to a battery charging circuitry 88.

In some embodiments, the operation control circuit 80 is in the form of a packaged integrated circuit ("IC"). In an example, the packaged IC includes a first contact terminal "CAP" or "T1", a second contact terminal "GNU" or "T2", a third contact terminal "LED" or "T3", a fourth contact terminal "OUT" or "T4", and a fifth contact terminal "BAT" or "T5".

The capacitance measurement unit 82 of the example operation control circuit 80 as depicted in FIG. 6B comprises a sensing oscillator circuit 82*a* which is connected to the "CAP" terminal for receiving a capacitive input. The sensing oscillator circuit 82*a* when in operation will generate an oscillation frequency which is inversely proportional to the value of input capacitance at the "CAP" terminal. Output of the sensing oscillator circuit 82*a* is fed to a frequency counter 82*b*. The frequency counter 82*b* is connected to an internal oscillator 82*b* which is to generate a reference oscillation frequency so that the frequency counter 82*b* can determine the instantaneous frequency of oscillation signals generated by the sensing oscillator circuit 82*a* with reference to the reference oscillation frequency. Output of the frequency counter 82*b* is fed to a comparison logic circuit 82*d* and a register circuit 82*e*. The comparison logic circuit 82*b* compares the output of the frequency counter 82*b* and the output of the register circuit 82*e* to give a 'sign' output to indicate whether inhaling or exhaling is detected, a first threshold level 'L0' and a second threshold level 'L1'. The outputs of the comparison logic circuit 82*d* are fed back to a reference update logic circuit 82*f* to provide update reference information to the register circuit 82*e*.

An example battery powered smoking puff detection and actuation module 20A depicted in FIG. 7 comprises the smoking puff detection module 20 of FIG. 2 and further includes an integrated circuit (IC) of the operation control circuit 80 which is mounted inside the air chamber and on a top surface of the PCB which faces the second conductive plate member 22.

The contact terminals on the IC are connected to correspondingly numbered contact terminals on the PCB. When the contact terminals on the IC are connected with correspondingly numbered contact terminals on the PCB, the input terminal ("CAP") to the capacitance measurement unit 82 will be connected to the second conductive plate member 22 via the conductive first holding ring 25*a* and the "GNU" terminal will be connected to the first conductive plate member 21 via the conductive second holding ring 25*b* and the peripheral wall of the metal can.

A plurality of contact terminals is formed on the PCB. The contact terminals include a first terminal ("T1") which is connected to the second conductive plate member 22 through the conductive first holding ring 25*a*, a second terminal ("T2") which is connected to the first conductive plate member 21 by means of the metal can casing and the conductive second holding ring 25*b*, a third terminal ("T3") for connecting to an indicator, a fourth terminal ("T4") for outputting drive power to an external device, and a fifth terminal ("T5") for obtaining power for overall operation.

An example electronic smoke 100 depicted in FIG. 8 comprises an electronic arrangement of FIG. 8A. The electronic arrangement comprises a battery powered smoking puff detection and actuation module 20A, a rigid main housing 40, a flavour source and a vaporizer 160, and a battery 180. In this example, the smoking puff detection and actuation module 20A is disposed inside the main housing 40 with the ceiling portion facing the air inlet end.

The flavour source and a vaporizer 160 may be in a packaged form known as a 'cartomizer' which contains a flavoured liquid and has a built-in electric heater which is powered by the battery to operate as an atomiser. The flavoured liquid, also known as e-juice or e-liquid, is usually a solution comprising organic substances, such as propylene glycol (PG), vegetable glycerine (VG), polyethylene glycol 400 (PEG400) mixed with concentrated flavours, liquid nicotine concentrate, or a mixture thereof.

During operation, the capacitance measurement unit 82 is powered by the battery to track the capacitive output value of the puff detection sub-assembly by monitoring oscillation frequency generated by the sensing oscillator circuit 82*a*. As the oscillation frequency of the sensing oscillator circuit 82*a* is inversely proportional to the input capacitance value at the "CAP" terminal, a change in the effective separation distance between the first 21 and the second 22 conductive plate members will bring about a change in the capacitive output value of the puff detection sub-assembly and hence the input capacitance value at the "CAP" terminal and the oscillation frequency generated by the sensing oscillator circuit 82*a*. When the surface deflection of the first conductive plate member 21 with respect to the second conductive plate member 22 reaches a prescribed threshold value and is in an axial direction signifying smoking inhaling, the microcontroller 84 will turn on operational power supply at the "OUT" terminal to the vaporizer to generate flavoured fume or smoke to simulate smoking effects. At the same time, the LED (light emitting diode) will be turned on. When the axial deflection is below the prescribed threshold value, the operational power supply will be turned off to end vaporizing.

With the puff detection sub-assembly disposed such that the first conductive plate member 21 is facing the air inlet, an inhaling puff will decrease the effective separation distance as shown in FIG. 3A and also the oscillation frequency, and an exhaling puff will increase the effective separation distance as shown in FIG. 3A and increase the oscillation frequency. Therefore, the direction of air flow is determinable with reference to the increase of decrease in oscillation frequency.

With the puff detection sub-assembly is reversely disposed such that the first conductive plate member 21 is facing away from the air inlet, the relationship will be reversed such that an inhaling puff will increase the effective separation distance as shown in FIG. 3B and also the oscillation frequency, and an exhaling puff will decrease the effective separation distance as shown in FIG. 3A and decrease the oscillation frequency.

In some embodiments, the conductive plate member proximal the ceiling portion of the metal can is a formed as a rigid and perforated conductive plate while that proximal the floor portion is a flexible and resilient membrane.

Therefore, the direction and strength of air flow is determinable with reference to the increase of decrease in oscillation frequency and the direction of disposition of the puff detection sub-assembly and this information is utilizable to operable the electronic smoke.

In example embodiments, the sensing oscillator circuit 82*a* is set to oscillate at between 20-80 kHz and an internal reference clock signal of 32 Hz is used to determine the change in oscillation frequency and hence the direction and flow rate of air through the air passageway.

In example embodiments, an actuation threshold of say 1.6% in the right direction may be set as a threshold to actuate vaporiser operation.

In example embodiments, a cessation threshold of say 0.4% may be selected to end vaporiser operation.

In example embodiments, the microcontroller 84 will take the oscillation frequency on power up or during an idle period as a reference oscillation frequency of the non-deformed state of the puff detection sub-assembly.

In example operations using the example puff detection sub-assembly, the air flow rate and frequency change characteristics has a non-linear relationship as depicted in FIG. 9A. By setting a low actuation threshold of only a few per cent change, for example, 1.6%, a simulated smoking puff resembling that of tobacco smoking will result while the risk of inadvertent actuation is substantially mitigated. In general, an actuation threshold below 3% can be used. By using a 32 Hz reference signal, the change in oscillation frequency can be represented in terms of data count by the data counter 82*b* of FIG. 6B and as depicted in FIG. 9B.

In an example simulated smoking inhaling puff as depicted in FIG. 9C, the microcontroller 84 turns on the vaporizer when the frequency change reaches the actuation threshold change of 1.6% and turn of the vaporizer when the frequency change falls to the cessation threshold change of 1.6%, generating a simulated smoking puff having duration of about 3 seconds.

During operations, the counter 82*b* (Current Counter) of the capacitance measurement unit 82 will compare number of clock count from the sensing oscillator 82*a* to the internal oscillator 82*c* and generate a current count. The comparison logic circuit 82*d* will compare reference count stored in the reference register 82*e* and the count value from current counter and generate a difference value (Change Count Data), Sign indicator (inhale/exhale) and two sense level L1 (e.g. capacitance changes>1.6%) and L0 (e.g. capacitance changes>0.4%). A reference updated logic update the reference count will be stored in the reference register 82*e* according to an updating algorithm. When the sensor's capacitance changes (increase or decrease depending on the direction), the frequency (CKS) of the sensing oscillator will change accordingly. The counter will count the total number of oscillations of CKS in the sampling period. The length of the sampling period is defined by the internal oscillator. When sensor's capacitance changes, the count changes accordingly.

The comparison logic will compare the new count with the reference count. It will output four signals (Changes Data Counts, Sign, L1, and L0) for subsequent circuit. "Changes Data Counts" represent the difference between the new count and the reference count. "Sign" represents the direction of the pressure applied. "L1" goes high when the change is higher than a value S1, say 1.6%. "L0" goes high when the change is higher than another value S0, say 0.4%. (S1>S0). The signals (Changes Data Counts, Sign, L1, and L0) will be used by internal or external processor to implement other e-cigar functions. (E.g. E-liquid heating, LED indicator, battery charging, short circuit/battery protection, puff habit behaviour record . . . etc)

In another example simulated smoking inhaling puff as depicted in FIG. 9D having a somewhat different inhaling pattern, the microcontroller 84 turns on the vaporizer when the frequency change reaches the actuation threshold change of 1.6% and turn of the vaporizer when the frequency change falls to the cessation threshold change of 1.6%, generating a simulated smoking puff having a duration of about 2 seconds.

Other example smoking inhaling patterns are depicted in FIGS. 9E to 9H.

As either the first or the second conductive plate member can be a flexible and resiliently deformable air flow detection plate, the effective separation distance to be monitored will be due to the relative effective surface separation between the first and the second conductive plate members.

In some embodiments, the microcontroller 84 is a digital signal processor (DSP). A DSP facilitates measurements of capacitance values and the puff detection sub-assembly is to operate as an air-flow sensor to give a capacitive output to operate a a capacitor of an oscillator circuit of the DSP. In this regard, the capacitive output terminals of the air-flow sensor are connected to the oscillator input terminals of the DSP. Instead of measuring the actual capacitance of the air flow sensor, the present arrangement uses a simplified way to determine the capacitance value or the variation in capacitance by measuring the instantaneous oscillation frequency of the oscillator circuit or the instantaneous variation in oscillation frequency of the oscillator circuit compared to the neutral state frequency to determine the instantaneous capacitance value or the instantaneous variation in capacitance value. For example, the oscillation frequency of an oscillator circuit increases and decreases respectively when the capacitor forming part of the oscillator decreases and increases.

To utilize these frequency characteristics, the neutral frequency of the oscillator, that is, the oscillation frequency of the oscillator circuit of the DSP with the air-flow sensor in the condition of FIG. 2 or 3 is calibrated or calculated and then stored as a reference oscillation reference. The variation in oscillation frequency in response to a suction action is plotted against flow rate so that the DSP would send an actuation signal to the heater or the heater switch when an inhaling action reaching a threshold air-flow rate has been detected. On the other hand, the DSP will not actuate the heater if the action is a blowing action to mitigate false heater triggering.

Naturally, the detection threshold frequency would depend on the orientation of the air-flow sensor. For example, if the air-flow sensor is disposed within the main housing with the upper aperture facing the LED end of the electronic smoke, an increase in oscillation frequency (due to decrease in capacitance as shown in FIG. 4B) of a sufficient threshold would correspond to a suction action of a threshold air-flow rate requiring heating activation, while a decrease in oscillation frequency (due to increase in capacitance as FIG. 4A) would correspond to a blowing action requiring no heating activation regardless of the air flow rate.

On the other hand, if the air-flow sensor is disposed in an opposite orientation such that the lower aperture is opposite the LED end, an increase in oscillation frequency (due to decrease in capacitance) of a sufficient threshold would correspond to a blowing action requiring no heater activation regardless of the air flow rate, while a decrease in oscillation frequency (due to increase in capacitance) would correspond to a suction action requiring heating activation when a threshold deviation in frequency is detected.

An electronic cigarette typically includes a flavoured smoke generator and electronic circuitry which are housed in an elongate housing. The elongate housing is adapted for finger holding and comprises a mouth piece which defines an air passage way connecting the flavoured smoke generator to a user such that smoke flavoured vapour generated in response to a suction action by a user will be delivered to the user via the mouth piece.

The electronic circuitry typically comprises an electric heater which is to operate to heat up a medium which is soaked with a flavoured liquid. The medium is usually a liquid affinity medium or a liquid retention medium such as cotton or glass fibre. The flavoured liquid, also known as e-juice or e-liquid, is usually a solution comprising organic substances, such as propylene glycol (PG), vegetable glycerine (VG), polyethylene glycol 400 (PEG400) mixed with concentrated flavours, liquid nicotine concentrate, or a mixture thereof.

A flavoured smoke generator may comprise a cartridge and an atomiser. A cartridge is usually a small plastic, glass or metal container with openings at each end which is adapted to serves as both a liquid reservoir holding the flavoured liquid and a mouthpiece. An atomizer is provided to cause vaporization of the flavoured liquid and typically contains a small heater filament and a wicking material which draws the flavoured liquid from the reservoir of the cartridge in contact or in close proximity to the heater filament. When the electronic cigarette operates, the heater filament will heat up the liquid soaked wicking material and flavoured smoke will be generated for delivery to a user.

An example electronic smoke apparatus 200 depicted in FIG. 10A comprises a main housing 210 inside which a flavoured source 212, a battery 214, operation circuitry 220, excitation element 228 and puffing detector 240 are housed. The main housing 210 is elongate, hollow and defines a tubular portion which joins an inhaling aperture 216 and an air inlet aperture 218. The inhaling aperture 216 is defined at one free axial end (or the suction end) of the tubular portion, the air inlet aperture 218 is defined at another axial end which is opposite to the suction end, and a channel 217 is defined by a portion of the tubular portion interconnecting the inhaling aperture 216 and the air inlet aperture 218.

The flavoured source 212 is contained inside a reservoir 230 near the suction end of the main housing 210. The reservoir has an internal wall which defines the outer boundary of the portion of the tubular portion near the suction end. A flavoured substance outlet 232 is formed on the internal wall so that flavoured substances contained in the flavoured source 212 can be released through the flavoured substance outlet 232 into the channel 217 to facilitate fume generation. The main housing 210 has a substantially circular outline to resemble the appearance of a cigarette or cigar and the suction end would serve as a mouth piece to be in contact with the lips of a user during simulated smoking operation.

In operation, air flows into the main housing 210 through the air inlet aperture 218 in response to suction of a user at the suction end. The incoming air flows along an air passageway defined by the channel 217 and exits through the inhaling aperture 216 after traversing a portion of the channel 217 which is surrounded by the reservoir 230 and picking up a flavoured fume during the passage.

The example electronic smoke apparatus 200 of FIG. 10A is detachable into a first module 250A and a second module 250B as depicted in FIG. 10B. The first module 250A comprises a first housing portion 210A and the second module 250B comprises a second housing portion 210B. The first and second housing portions 210A, 210B are axially aligned and include counterpart attachment parts to facilitate releasable attachment between the first 250A and the second 250B modules to form a single elongate and continuous piece of smoking apparatus with electrical communication between the first 250A and the second 250B modules. The counterpart attachment parts include complementary fastening counterparts to facilitate releasable fastening engagement between the first 250A and second 250B modules when axially aligned, coupled and engaged.

The puffing detector 240, the operation circuitry 220, and the battery 214 are housed inside a hollow chamber defined inside the first housing portion 210A. The first housing portion 210A is rigid and elongate and the air inlet aperture 218 is formed on or near one axial end of the first housing portion 210A to define the air inlet end of the electronic smoke apparatus 200. The hollow chamber extends from the air inlet aperture 218 to a distal axial end or coupling end of the first housing portion 210A and forms part of the channel 217. The hollow chamber has an open end at the distal axial end of the first housing portion 210A. This open end is to couple with a corresponding open end of a corresponding hollow chamber on the second module 250B. When the corresponding open ends are so coupled and connected, the complete channel 217 is formed.

An attachment part for making detachable engagement with a counterpart attachment part on the second module 250B is formed on the distal axial end of the first housing portion 210A. The attachment part comprises contact terminals for making electrical contact with counterpart terminals on the counterpart attachment part of the second module 250B. An LED (light emitting diode) such as a red LED or one with red filter may be provided as an optional feature at the inlet end of the first housing portion 210A to provide simulated smoking effect if preferred. In this example, the contact terminals include or incorporate mode sensing terminals.

The second housing portion 2108 comprises an elongate rigid body having a first axial end which is the suction end and a second axial end or coupling end which is to enter into coupled mechanical engagement with the distal end of the first housing portion 210A. The rigid body includes a first hollow portion which defines another part of the channel 217. Contact terminals complementary to the contact terminals on the distal end of the first housing portion 210A are formed at the second axial end for making electrical contacts with the counterpart contact terminals on the first module 250A.The first hollow portion extends axially or longitudinally towards the inhaling aperture 216 and includes an elongate portion that is surrounded by the reservoir 230. A puffing sensor is disposed along the channel 217 to operate as the puffing detector 240 for detection of air movements representative of simulated smoking.

The second housing portion 210B includes an axially extending internal wall which surrounds the portion of the channel 217 inside the second module 250B and defines that portion of the channel 217. The internal wall cooperates with the wall of the second housing portion 2108 to define the reservoir 230. The flavoured source 212 may be in the form of a flavoured liquid such as e-juice or e-liquid. The reservoir outlet 232 is formed on the internal wall so that the reservoir 230 is in liquid communication with the channel 217 via the reservoir outlet 232. The excitation element 228 projects into the channel 217 so that a flavoured fume generated by the excitation element during operation will be picked up by a stream of air moving through the channel 217. A lead wire to provide excitation energy to the excitation element 228 extends from the contact terminals to enter the reservoir 230 and then projects into the channel 217 through the reservoir outlet 232 after traversing an axial length inside the reservoir 230 and connects to the excitation element 228. The lead wire serves as a liquid guide or liquid bridge to deliver flavoured liquid from the reservoir 230 to the excitation element 228. The lead wire also serves as a signal guide to deliver excitation signals to the excitation element 228.

An attachment part for making detachable engagement with a counterpart attachment part on the first module 250A is formed on the coupling end of the second housing portion 210B. The attachment part comprises contact terminals for making electrical contact with the counterpart terminals on the counterpart attachment part of the first module 250A. One of the contact terminals is optionally screw threaded to ensure good secure and reliable electrical contact between the first 250A and second 250B modules so that excitation power can flow reliably to the excitation element 128 from the operation circuitry 220 during operations. In this example, the excitation element 228 comprises a resistive heating element.

When the second module 250B is detached from the first module 250A, the contact terminals on the coupling end of the first module 250A are exposed. A charging power source such as a modular charging power source 260 having complementary electrical and mechanical contact terminals as depicted in FIG. 10C can be electrically coupled to the first module 250A to charge the battery 214 inside the first module 250A. Lithium ion rechargeable batteries having the identification number 68430 (6.8 mm in diameter and 43 mm in length) are widely used in electronic cigarettes. Other staple batteries that are commonly used in electronic cigarettes include lithium ion rechargeable batteries having identification numbers 18350, 18490, 18500 or 18650. The identification numbers of the latter batteries represent the dimensions in which the first two digits stand for diameter in mm and the last three digits stand for length in 0.1 mm units. Lithium ion batteries have a typical nominal voltage of about 3.6V or 3.7V and a usual capacity rating of several hundred mAh to several thousand mAh. Of course, rechargeable batteries of other sizes, dimensions, and materials can be used for smaller electronic apparatus of different sizes and different applications without loss of generality.

The example electronic smoke apparatus 300 depicted in FIG. 11A is substantially identical to that of FIG. 10A, except that the puffing detector 240 is proximal the coupling end and between the battery 214 and the contact terminals. The operation circuitry 220 is disposed intermediate the battery 214 and the puffing detector 240 in this example.

Figure 11B:
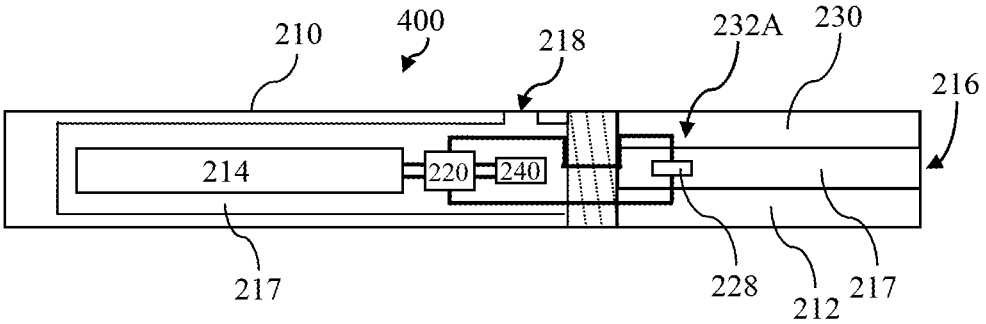

The example electronic smoke apparatus 400 depicted in FIG. 11B is substantially identical to that of FIG. 11A, except that the air inlet aperture 218 is formed on a side of the main housing 210 and proximal the coupling end to provide an inlet path into the channel 217. In this example, the channel 217 is closed at the free axial end of the main housing which is distal from the suction end.

Figure 11C:
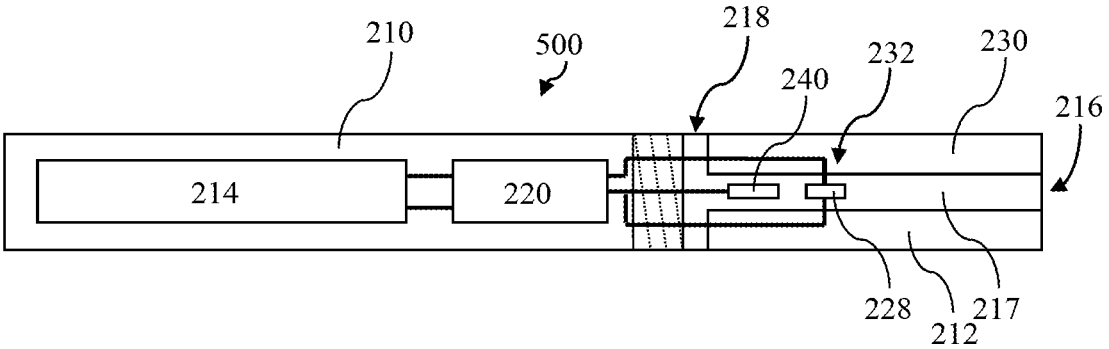

The example electronic smoke apparatus 500 depicted in FIG. 11C is substantially identical to that of FIG. 11B, except that the air inlet aperture 218 and the puffing detector 240 is in the portion of the main housing corresponding to the second module 250B and proximal the coupling end.

The example electronic smoke apparatus 600 depicted in FIG. 12 is substantially identical to that of FIG. 110, except that activation is by means of a switch 240A instead of the puffing detector 240.

While various configurations have been described herein, it should be appreciated that the configurations are non-limiting examples. For example, the air inlet aperture may be on an axial free end or on a side wall of the main housing, the puff detector may be proximal the air inlet aperture or further in the channel, and the operation circuitry 120 may be inside or outside of the channel without loss of generality.

While the present invention has been explained with reference to the embodiments above, it will be appreciated that the embodiments are only for illustrations and should not be used as restrictive example when interpreting the scope of the invention.

The invention claimed is:

1. An electronic vaping device comprising:
a puff sensor assembly including
a controller,
a metal casing, and
a capacitor without an electret layer, the capacitor arranged in the metal casing and connected to the controller, the capacitor including a flexible conductive membrane and a rigid conductive plate spaced apart by an insulating spacer and an air dielectric between the flexible conductive membrane and the rigid conductive plate;
wherein the flexible conductive membrane is configured to deform based on airflow through the electronic vaping device; and
wherein the puff sensor assembly is configured to
sense a rate and direction of the airflow through the electronic vaping device, and
selectively actuate a heater based on the rate and direction of the airflow through the electronic vaping device.

2. The electronic vaping device of claim 1, wherein
the metal casing has an opening at a first end of the metal casing.

3. The electronic vaping device of claim 2, wherein the rigid conductive plate is arranged between the flexible conductive membrane and the first end of the metal casing.

4. The electronic vaping device of claim 2, wherein the capacitor is arranged with the rigid conductive plate proximal to the first end of the metal casing.

5. The electronic vaping device of claim 1, further comprising:
a circuit board spaced apart from the capacitor by a conductive ring between the capacitor and the circuit board.

6. The electronic vaping device of claim 5, wherein the circuit board is electrically connected to the capacitor via the conductive ring.

7. The electronic vaping device of claim 1, wherein the controller is configured to sense the rate and direction of the airflow through the electronic vaping device by detecting a change in a variable capacitance of the capacitor caused by deformation of the flexible conductive membrane.

8. The electronic vaping device of claim 1, further comprising:
a battery configured to provide power to the electronic vaping device;
a reservoir configured to hold liquid formulation; and
the heater, wherein
the heater is configured to heat liquid formulation drawn from the reservoir.

9. The electronic vaping device of claim 1, wherein the puff sensor assembly is configured to
detect a draw action at an end of the electronic vaping device based on the rate and direction of the airflow through the electronic vaping device;
detect a blowing action at the end of the electronic vaping device based on the rate and direction of the airflow through the electronic vaping device; and
actuate the heater in response to detecting the draw action, but not in response to detecting the blowing action.

10. The electronic vaping device of claim 1, wherein the capacitor consists essentially of the flexible conductive membrane and the rigid conductive plate spaced apart by the insulating spacer and the air dielectric between the flexible conductive membrane and the rigid conductive plate.

11. The electronic vaping device of claim 1, wherein the insulating spacer is a ring-shaped insulating spacer.

12. An electronic vaping device comprising:
a controller including an oscillation circuit; and
a puff sensor including
a metal casing, and
a capacitor without an electret layer, the capacitor arranged in the metal casing and connected to the oscillation circuit, the capacitor including a flexible conductive membrane and a rigid conductive plate spaced apart by an insulating spacer and an air dielectric between the flexible conductive membrane and the rigid conductive plate;
wherein the flexible conductive membrane is configured to deform in response to airflow through the electronic vaping device; and
wherein the controller is configured to measure a variation in an oscillation frequency of the oscillation circuit, and to selectively actuate a heater based on the variation in an oscillation frequency of the oscillation circuit.

13. The electronic vaping device of claim 12, wherein the metal casing has an opening at an end of the metal casing.

14. The electronic vaping device of claim 13, wherein the rigid conductive plate is arranged between the flexible conductive membrane and the end of the metal casing.

15. The electronic vaping device of claim 12, wherein capacitive output terminals of the capacitor are connected to input terminals of the oscillation circuit.

16. The electronic vaping device of claim 12, wherein the controller is further configured to
detect a draw action at an end of the electronic vaping device based on the variation in an oscillation frequency of the oscillation circuit; and
actuate the heater in response to detecting the draw action.

17. The electronic vaping device of claim 16, wherein the controller is further configured to output an actuation signal to the heater to actuate the heater in response to detecting the draw action.

18. The electronic vaping device of claim 12, further comprising:
a battery configured to provide power to the electronic vaping device;
a reservoir configured to hold liquid formulation; and
the heater, wherein
the heater is configured to heat liquid formulation drawn from the reservoir.

19. The electronic vaping device of claim 12, wherein
the controller is further configured to detect a blowing action at an end of the electronic vaping device based on the variation in an oscillation frequency of the oscillation circuit; and
the controller does not actuate the heater in response to detecting the blowing action.

20. The electronic vaping device of claim 12, wherein
a capacitance value of the capacitor varies in response to the airflow through the electronic vaping device caused by both a draw action and a blowing action at an end of the electronic vaping device;
the variation in an oscillation frequency of the oscillation circuit is based on a variation in the capacitance value of the capacitor; and
the controller is further configured to
determine a rate and direction of the airflow through the electronic vaping device based on the variation in an oscillation frequency of the oscillation circuit, and selectively actuate the heater based on the rate and direction of the airflow through the electronic vaping device.

21. The electronic vaping device of claim 12, wherein the capacitor consists essentially of the flexible conductive membrane and the rigid conductive plate spaced apart by the insulating spacer and the air dielectric between the flexible conductive membrane and the rigid conductive plate.

22. The electronic vaping device of claim 12, wherein the insulating spacer is a ring-shaped insulating spacer.

23. An electronic vaping device comprising:

a controller; and a puff sensor connected to the controller, the puff sensor including a metal casing and a capacitor without an electret layer, the capacitor arranged in the metal casing and including a flexible conductive membrane and a rigid conductive plate spaced apart by an insulating spacer and an air dielectric between the flexible conductive membrane and the rigid conductive plate;

wherein the flexible conductive membrane is configured to deform in response to airflow through the electronic vaping device;

wherein the puff sensor is configured to sense a rate and direction of the airflow through the electronic vaping device; and wherein the controller is configured to selectively actuate a heater based on the rate and direction of the airflow through the electronic vaping device.

24. The electronic vaping device of claim 23, wherein the metal casing has an opening at an end of the metal casing.

25. The electronic vaping device of claim 24, wherein the rigid conductive plate is arranged between the flexible conductive membrane and the end of the metal casing.

26. The electronic vaping device of claim 23, wherein the controller is further configured to selectively output an actuation signal to selectively actuate the heater based on the rate and direction of the airflow through the electronic vaping device.

27. The electronic vaping device of claim 23, wherein the controller is configured to detect a draw action at an end of the electronic vaping device based on the rate and direction of the airflow through the electronic vaping device;

detect a blowing action at the end of the electronic vaping device based on the rate and direction of the airflow through the electronic vaping device; and actuate the heater in response to detecting the draw action, but not in response to detecting the blowing action.

28. The electronic vaping device of claim 23, further comprising:

a battery configured to provide power to the electronic vaping device;

a reservoir configured to hold liquid formulation; and the heater, wherein the heater is configured to heat liquid formulation drawn from the reservoir.

29. The electronic vaping device of claim 23, wherein the capacitor consists essentially of the flexible conductive membrane and the rigid conductive plate spaced apart by the insulating spacer and the air dielectric between the flexible conductive membrane and the rigid conductive plate.

30. The electronic vaping device of claim 23, wherein the insulating spacer is a ring-shaped insulating spacer.

* * * * *